US011162731B2

(12) United States Patent
Aranda et al.

(10) Patent No.: US 11,162,731 B2
(45) Date of Patent: Nov. 2, 2021

(54) DOOR GASKET ASSEMBLY FOR A REFRIGERATED APPLIANCE

(71) Applicant: WHIRLPOOL CORPORATION, Benton Harbor, MI (US)

(72) Inventors: Jose R. Aranda, Stevensville, MI (US); Alexa N. Brown, Mishawaka, IN (US); Jackson Felipe Karl, St. Joseph, MI (US); Dakota E. Kosek, Benton Harbor, MI (US); Rishikesh Vinayak Kulkarni, Hefei (CN); E. C. Pickles, St. Joseph, MI (US); Antonio Sanchez, Stevensville, MI (US); Richard A. Spletzer, St. Joseph, MI (US)

(73) Assignee: Whirlpool Corportation, Benton Harbor, MI (US)

( * ) Notice: Subject to any disclaimer, the term of this patent is extended or adjusted under 35 U.S.C. 154(b) by 425 days.

(21) Appl. No.: 16/295,726

(22) Filed: Mar. 7, 2019

(65) Prior Publication Data

US 2020/0284500 A1 Sep. 10, 2020

(51) Int. Cl.

| | |
|---|---|
| ***F25D 23/08*** | (2006.01) |
| ***F25C 1/24*** | (2018.01) |
| ***F25D 11/02*** | (2006.01) |
| ***F25D 23/02*** | (2006.01) |

(52) U.S. Cl.

CPC ..... *F25D 23/087* (2013.01); *F25C 1/24* (2013.01); *F25D 11/02* (2013.01); *F25D 23/028* (2013.01); *F25D 2201/12* (2013.01); *F25D 2600/04* (2013.01)

(58) Field of Classification Search

CPC ..... F25D 23/087; F25D 23/028; F25D 11/02; F25D 2201/12; F25D 2600/04; F25D 21/04; F25C 1/24; F25C 2400/10

See application file for complete search history.

(56) References Cited

U.S. PATENT DOCUMENTS

| | | | | |
|---|---|---|---|---|
| 4,653,819 | A * | 3/1987 | Swerbinsky | F25D 23/087 312/296 |
| 8,438,869 | B2 | 5/2013 | Kim et al. | |
| 9,021,828 | B2 | 5/2015 | Vitan et al. | |
| 9,175,896 | B2 * | 11/2015 | Choi | F25C 5/22 |
| 2002/0184828 | A1 * | 12/2002 | Park | F25D 23/087 49/489.1 |
| 2003/0019159 | A1 * | 1/2003 | Holmqvist | E05C 19/161 49/478.1 |

(Continued)

FOREIGN PATENT DOCUMENTS

| | | |
|---|---|---|
| CN | 206755703 U | 12/2017 |
| KR | 20090132283 A | 12/2009 |

(Continued)

*Primary Examiner* — Emmanuel E Duke
(74) *Attorney, Agent, or Firm* — Price Heneveld LLP

(57) ABSTRACT

An icemaker for a refrigerator appliance is provided. The icemaker includes an icemaker box selectively closeable by a door. An outer gasket is positioned about an inner edge of the door. A sealing gasket is positioned around a center portion of the door. A plurality of protrusions extend from a box rim of the icemaker box. A liner is aligned with and spaced apart from the box rim. A first gasket and a second gasket are positioned between the box rim and the liner.

20 Claims, 20 Drawing Sheets

(56) References Cited

U.S. PATENT DOCUMENTS

| | | | | |
|---|---|---|---|---|
| 2007/0084125 | A1* | 4/2007 | Gholap | F25D 23/087 49/478.1 |
| 2008/0276540 | A1* | 11/2008 | Kim | F25D 23/087 49/478.1 |
| 2009/0007587 | A1* | 1/2009 | Lanzl | A47F 3/0434 62/449 |
| 2009/0058246 | A1* | 3/2009 | Cittadini | F25D 23/087 312/405 |
| 2009/0184615 | A1* | 7/2009 | Casoli | F25D 23/087 312/405 |
| 2009/0243453 | A1* | 10/2009 | Kang | F25D 23/087 312/405 |
| 2009/0277096 | A1* | 11/2009 | Ramos | F25D 23/087 49/478.1 |
| 2015/0330678 | A1 | 11/2015 | Hu | |
| 2017/0051966 | A1 | 2/2017 | Powell | |
| 2017/0292748 | A1 | 10/2017 | Gullett | |
| 2017/0343275 | A1 | 11/2017 | Kim | |
| 2018/0017309 | A1 | 1/2018 | Miller et al. | |

FOREIGN PATENT DOCUMENTS

| | | | |
|---|---|---|---|
| KR | 20100060514 | A | 6/2010 |
| KR | 20140145816 | A | 12/2014 |

* cited by examiner

DOOR GASKET ASSEMBLY FOR A REFRIGERATED APPLIANCE

FIELD

The present device generally relates to a gasket assembly, and more specifically for a gasket assembly for a refrigerator appliance.

BACKGROUND

Ice-making appliances are commonly disposed within refrigerator appliances. An improved ice making appliance is disclosed.

BRIEF SUMMARY OF THE DISCLOSURE

In at least one aspect, an icemaker for a refrigerator appliance is provided. The icemaker includes an icemaker box selectively closeable by a door. An outer gasket is positioned about an inner edge of the door. A sealing gasket is positioned around a center portion of the door. A plurality of protrusions extend from a box rim of the icemaker box. A liner is aligned with and spaced apart from the box rim. A first gasket and a second gasket are positioned between the box rim and the liner.

In at least another aspect, an icemaker for a refrigerator appliance is provided. The icemaker comprises an icemaker box defining an opening. The icemaker box is selectively closeable by an icemaker door. The icemaker door includes an inner surface. A box rim of the icemaker box defines an outer channel and an inner channel. The outer channel is defined by a first protrusion and a second protrusion. The inner channel is defined by the second protrusion and a third protrusion. A first gasket is positioned within the outer channel. A second gasket is positioned within the inner channel. A liner is positioned substantially flush with the icemaker box. An edge of the liner includes an inner surface. The inner surface of the edge encloses the outer channel and the inner channel. An outer gasket is positioned about the periphery of an inner surface of the icemaker door. The outer gasket includes a non-linear contact portion and a linear connecting portion.

In yet another aspect, an icemaker is provided that comprises an icemaker box selectively closeable by a door. The door includes an inner wall and an outer wall. The inner wall at least partially defines a slot. A box rim of the icemaker box defines first and second channels having open ends. A first gasket is positioned within the first channel. A second gasket is positioned within the second channel. An outer gasket is positioned about a periphery of the door. The outer gasket includes a contact portion and a connecting portion. The connecting portion is at least partially received by the slot.

These and other features, advantages, and objects of the present device will be further understood and appreciated by those skilled in the art upon studying the following specification, claims, and appended drawings.

DETAILED DESCRIPTION

Figure 1:
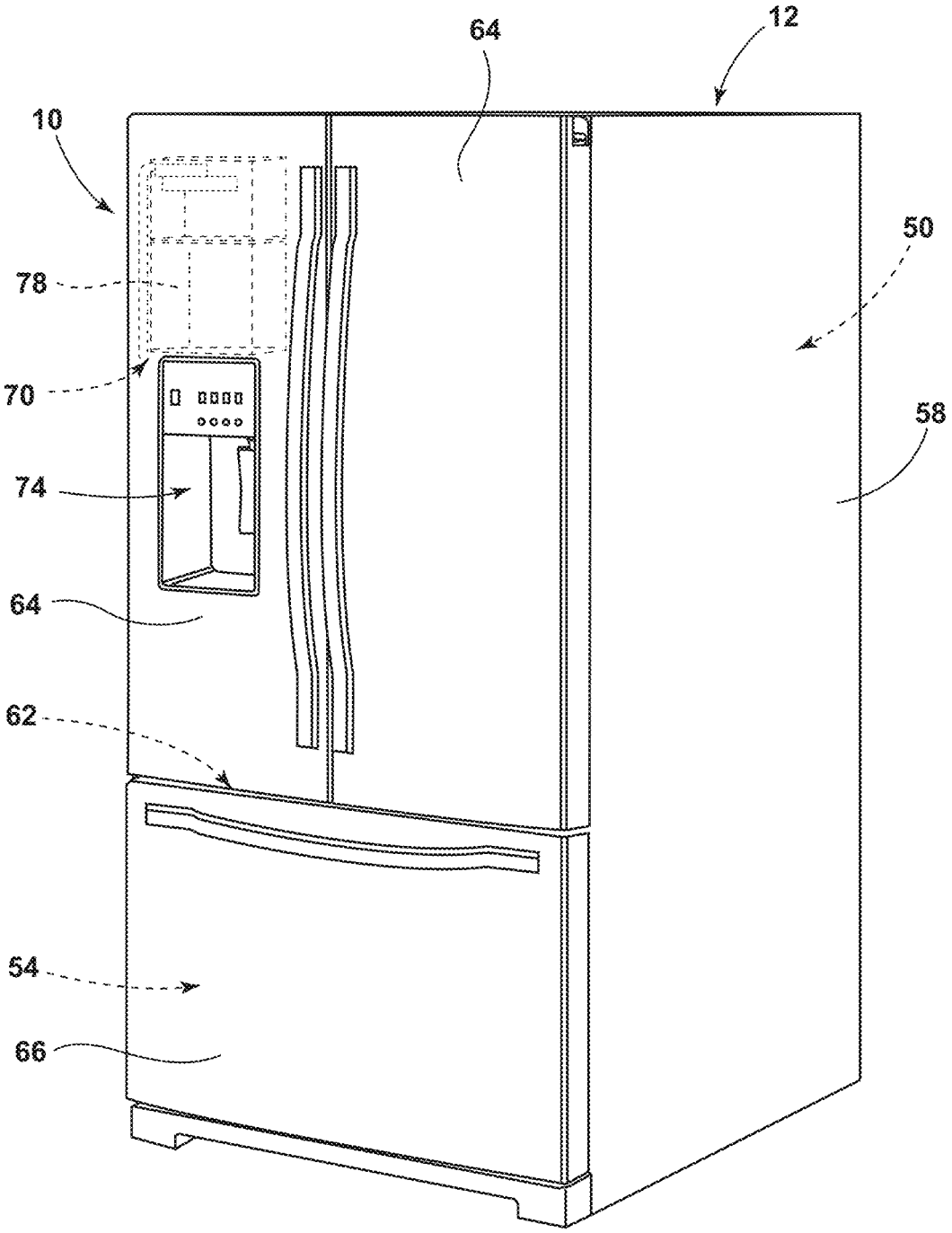
FIG. 1 is a side perspective view of a refrigeration appliance.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

With reference to FIGS. 1-12C, an icemaker 10 for a refrigerator appliance 12 may be provided. The icemaker 10 may include an icemaker box 14. The icemaker box 14 may be selectively closable by an icemaker door 16. An outer gasket 18 may be positioned about an inner edge 20 of the icemaker door 16. A sealing gasket 22 may be positioned around a center portion 24 of the icemaker door 16. A plurality of protrusions 26 may extend from a box rim 28 of the icemaker box 14. The plurality of protrusions 26 may define first and second channels 30, 32. Each of the first and second channels 30, 32 may have an open end 170, 180. A door liner 36 may be positioned to cover the open ends 170, 180. A first gasket 38 may be positioned within the first channel 30, and a second gasket 40 may be positioned within the second channel 32.

Figure 2:
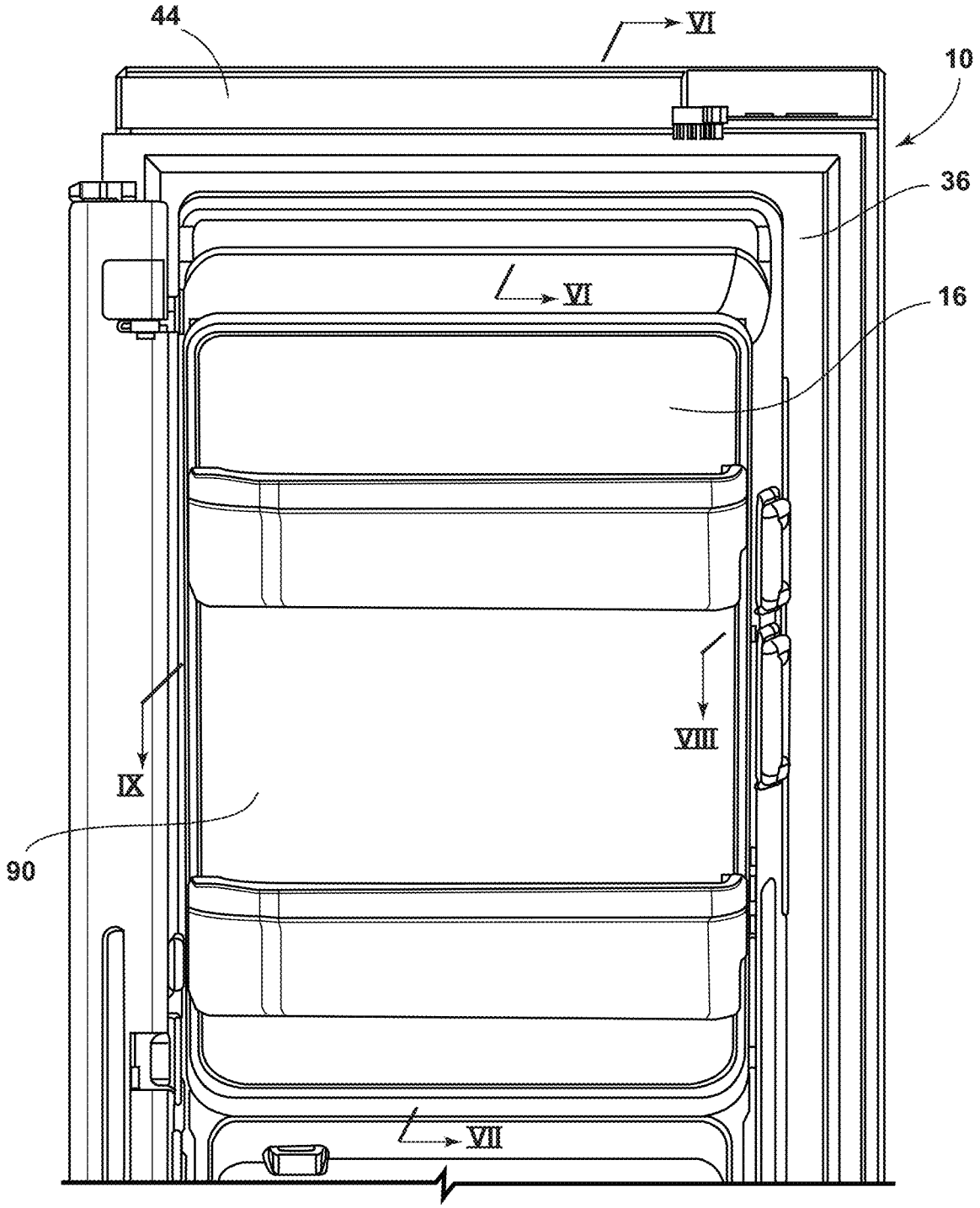
FIG. 2 is a rear profile view of an ice-making appliance positioned on an inner surface of a door of the refrigeration appliance of FIG. 1 with an icemaker door in a closed position according to some examples.

Referring to FIGS. 1 and 2, reference numeral 12 generally designates the refrigerator appliance with the icemaker 10. The icemaker 10 may be used as a stand-alone appliance or within another appliance, such as a refrigerator. The ice-making process may be induced, carried out, stopped, and the ice may be harvested with little, or no, user input. FIG. 1 generally shows a refrigerator of the French-door bottom mount type, but it is understood that this disclosure could apply to any type of refrigerator, such as a side-by-side, two-door bottom mount, or a top-mount type refrigeration unit.

As shown in FIGS. 1 and 2, the refrigerator appliance 12 may have a refrigerator compartment 50 configured to refrigerate consumables and a freezer compartment 54 configured to freeze consumables during normal use. Accordingly, the refrigerator compartment 50 may be kept at a temperature above the freezing point of water and generally below a temperature of from about 35° F. to about 50° F., more typically below about 38° F. and the freezer compartment 54 may be kept at a temperature below the freezing point of water.

In various examples, the refrigerator appliance 12 has a cabinet 58 and a cabinet liner within the cabinet 58 to define the refrigerator compartment 50 and the freezer compartment 54. A mullion 62 may separate the refrigerator compartment 50 and the freezer compartment 54.

The refrigerator appliance 12 may have one or more doors 64, 66 that provide selective access to the interior volume of the refrigerator appliance 12 where consumables may be stored. Refrigerator compartment doors 64 and a freezer door 66 are shown coupled to the refrigerator appliance 12. It is appreciated that the refrigerator compartment 50 may only have one door 64.

Figure 4:
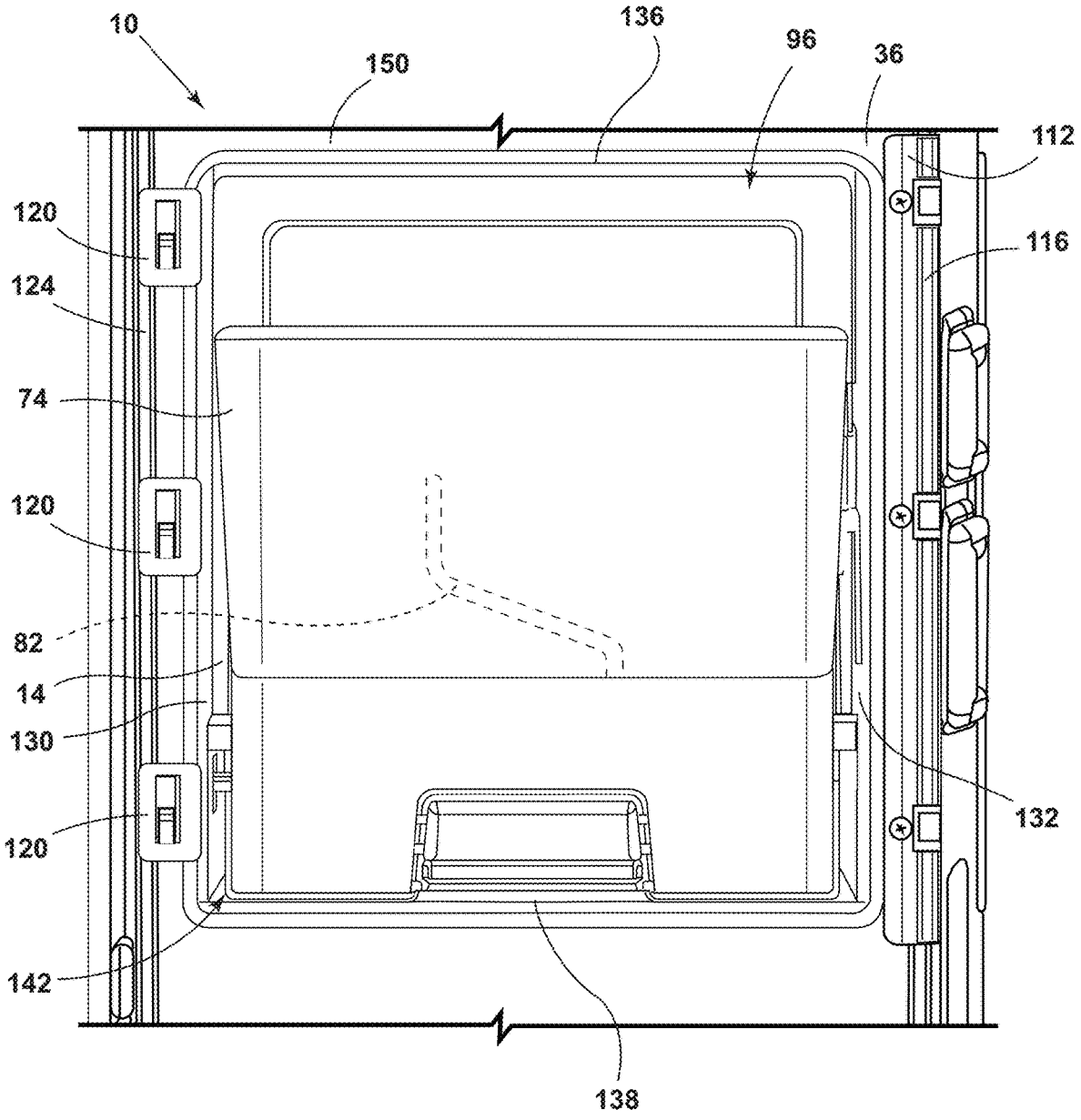
FIG. 4 is an enhanced rear profile view of the ice-making appliance of FIG. 3 with the icemaker door removed.

The icemaker 10 may be positioned within the door 64. The icemaker box 14 may be received by an icemaker receiving space 70 of the refrigerator appliance 12 to allow for delivery of ice through the door 64 in a dispensing area 74 on the exterior of the refrigerator appliance 12. The dispensing area 74 may be at a location on the exterior below the level of an ice storage bin 78 to allow gravity to force the ice down an ice dispensing chute in the refrigerator appliance door 64. The chute extends from the ice storage bin 78 to the dispensing area 74 and ice may be pushed into the chute using an auger 82 (FIG. 4).

Figure 3:
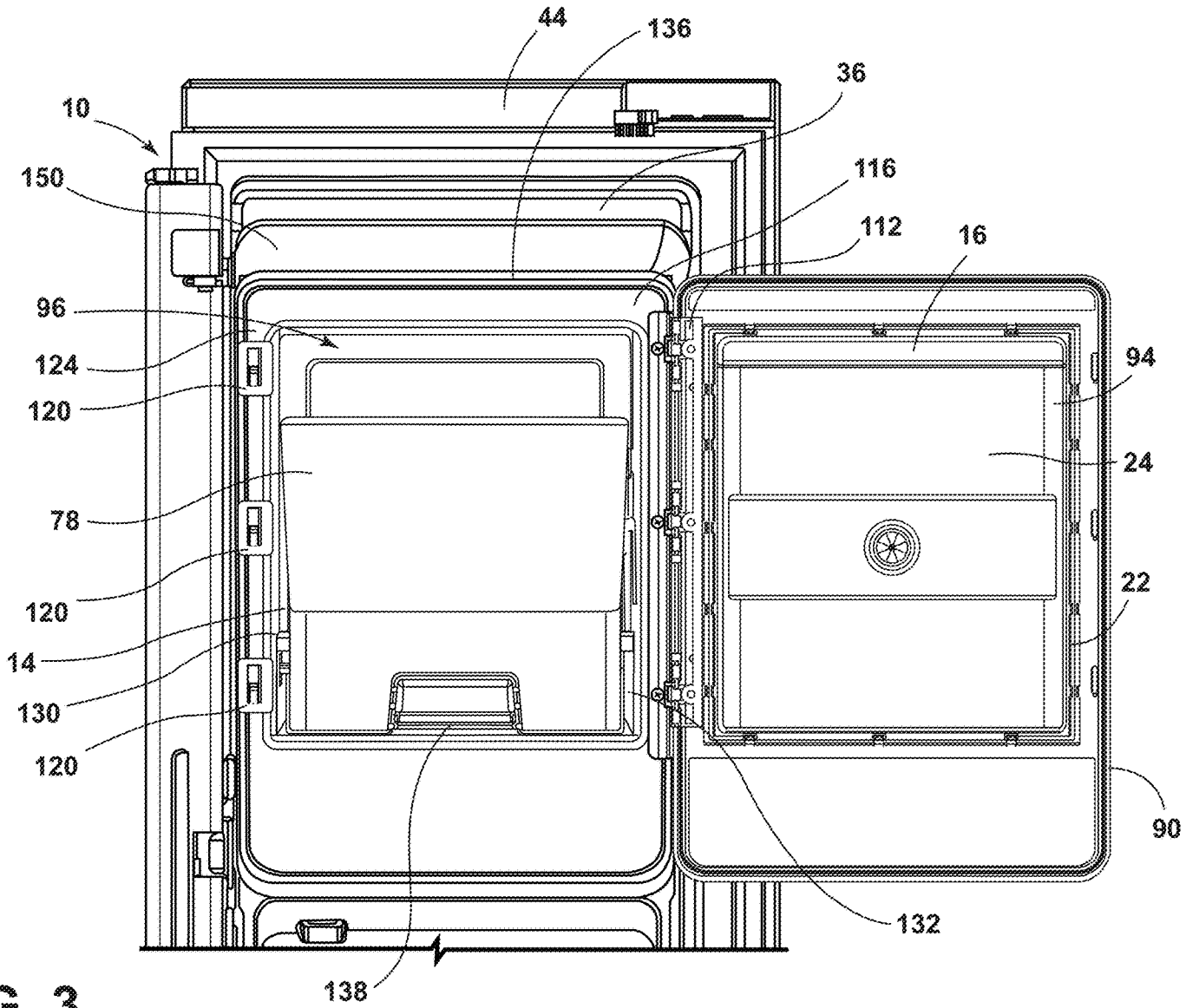
FIG. 3 is a rear profile view of the ice-making appliance of FIG. 2 with the icemaker door in an open position.

Referring now to FIGS. 2 and 3, the inner surface of the door 64 is shown having the icemaker 10 positioned within the door 64. The icemaker door 16 configured to selectively seal the icemaker box 14. The icemaker door 16 may be pivotally coupled to a hinge 112. The icemaker door 16 may be pivotable between a closed position (FIG. 2) and an open position (FIG. 3). The icemaker 10 may be accessible when the icemaker door 16 is in the open position. When the icemaker door 16 is in the closed position, the icemaker door 16 may be configured to seal an opening 96 defined by the icemaker box 14. The hinge 112 may be positioned on a first side 116 of the door liner 36. According to various examples, the hinge 112 may be a single hinge extending the length of the first side 116 of the door liner 36 proximate the opening 96 defined by the icemaker box 14. In other examples, the hinge 112 may be a plurality of hinges positioned along the first side 116 of the door liner 36 proximate the opening 96.

The icemaker door 16 may be secured in the closed position by a plurality of fasteners 120 positioned on a second side 124 of the door liner 36 proximate the opening 96 defined by the icemaker box 14. According to various examples, the plurality of fasteners 120 may be evenly spaced along the second side 124 of the door liner 36 proximate the opening 96 of the icemaker box 14. In other examples, the fasteners 120 may be unevenly spaced along the second side 124 of the door liner 36. It will also be understood any number of fasteners may be utilized to secure the icemaker door in the closed position, such as, for example, a single fastener or a pair of fasteners.

The icemaker door 16 may include an outer panel 90 operably coupled to an inner panel 94. The inner panel 94 may include the center portion 24. The center portion 24 may be configured to be received by the opening 96 defined by the icemaker box 14. According to various examples, the center portion 24 may be generally square or rectangular. In other examples, the center portion 24 may be circular, oblong, triangular, or any other higher order polygon. The opening 96 defined by the icemaker box 14 may be shaped to complement the center portion 24. The sealing gasket 22 may be positioned about the periphery of the center portion 24.

Figure 5:
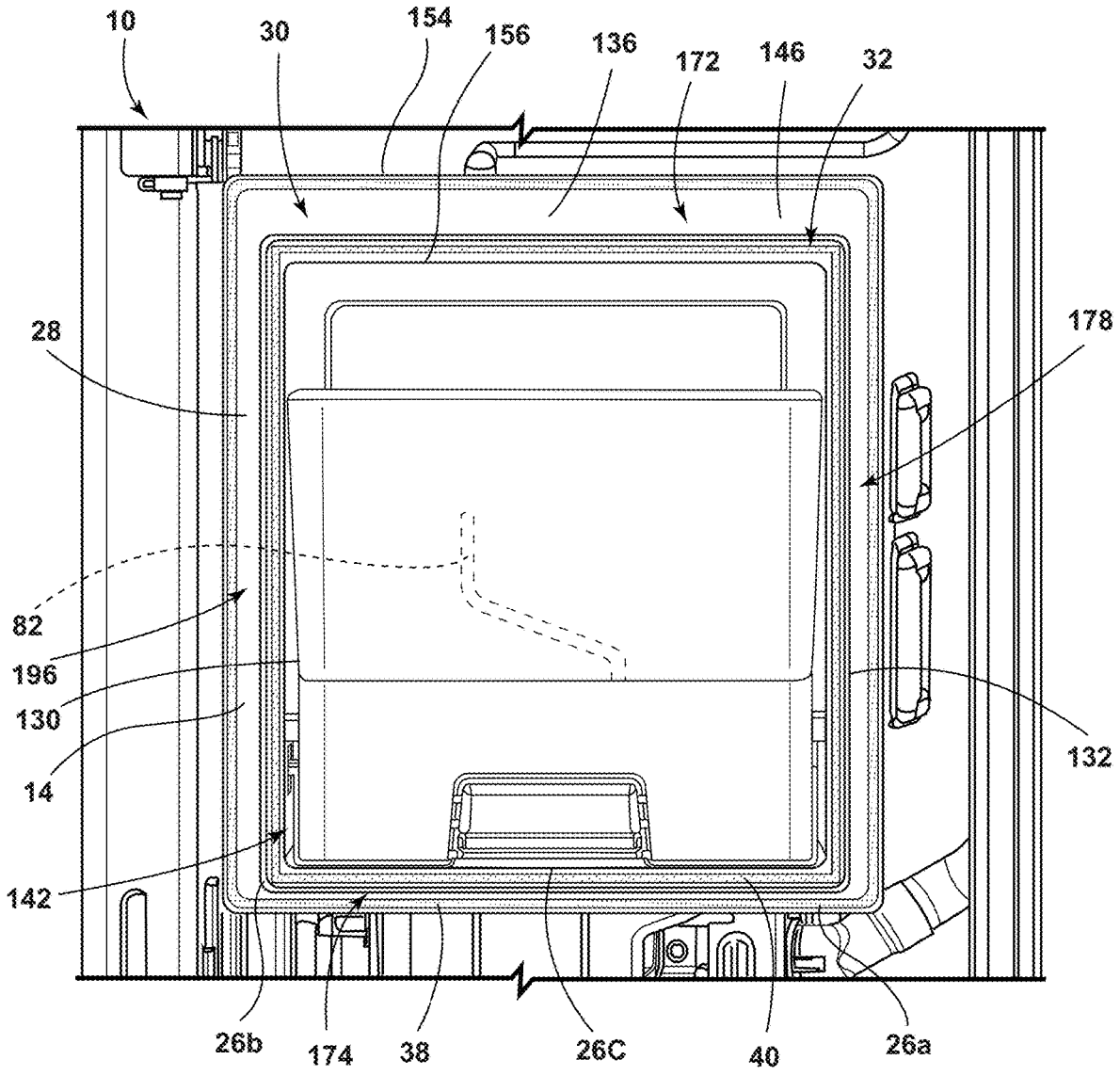
FIG. 5 is an enhanced rear profile view of the ice-making appliance of FIG. 3 with a liner removed.

Referring now to FIGS. 3-5, a liner rim 150 of the door liner 36 may extend over and flush with the icemaker box 14 and the box rim 28. The icemaker box 14 may include first and second sidewalls 130, 132 joined by an upper wall 136 and lower wall 138. The icemaker box may define a cavity 142 configured to receive the removable ice storage bin 78. The box rim 28 may extend around the opening 96. As shown in FIG. 5, the box rim 28 may be perpendicular to at least one wall 130, 132, 136, 138 of the icemaker box 14. The box rim 28 may vary in width across the length of the box rim 28. The box rim 28 may be positioned generally parallel to the liner rim 150 of the liner 36 extending over the box rim 28 (FIG. 4). The box rim 28 may include an outer edge 154 and inner edge 156. The inner edge 156 may be positioned between the outer edge 154 and the opening 96 of the icemaker box 14. According to various examples, the box rim 28 may have radiused corners where the walls 130, 132, 136, 138 meet. In other examples, the box rim 28 may have angular corners.

Figure 6:
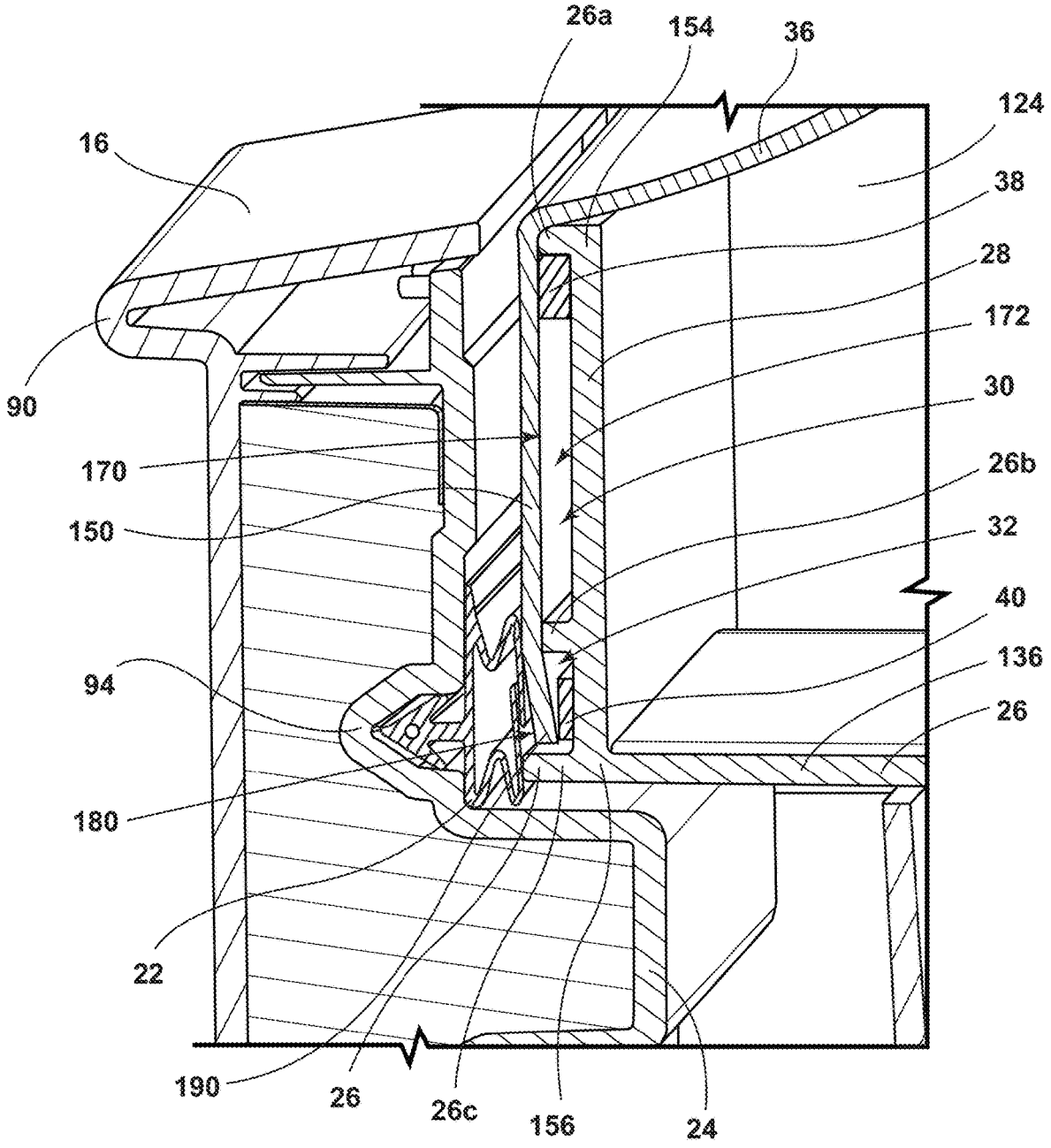
FIG. 6 is a cross-sectional view of a top of the ice-making appliance of FIG. 2 taken along line VI-VI.
Figure 7:
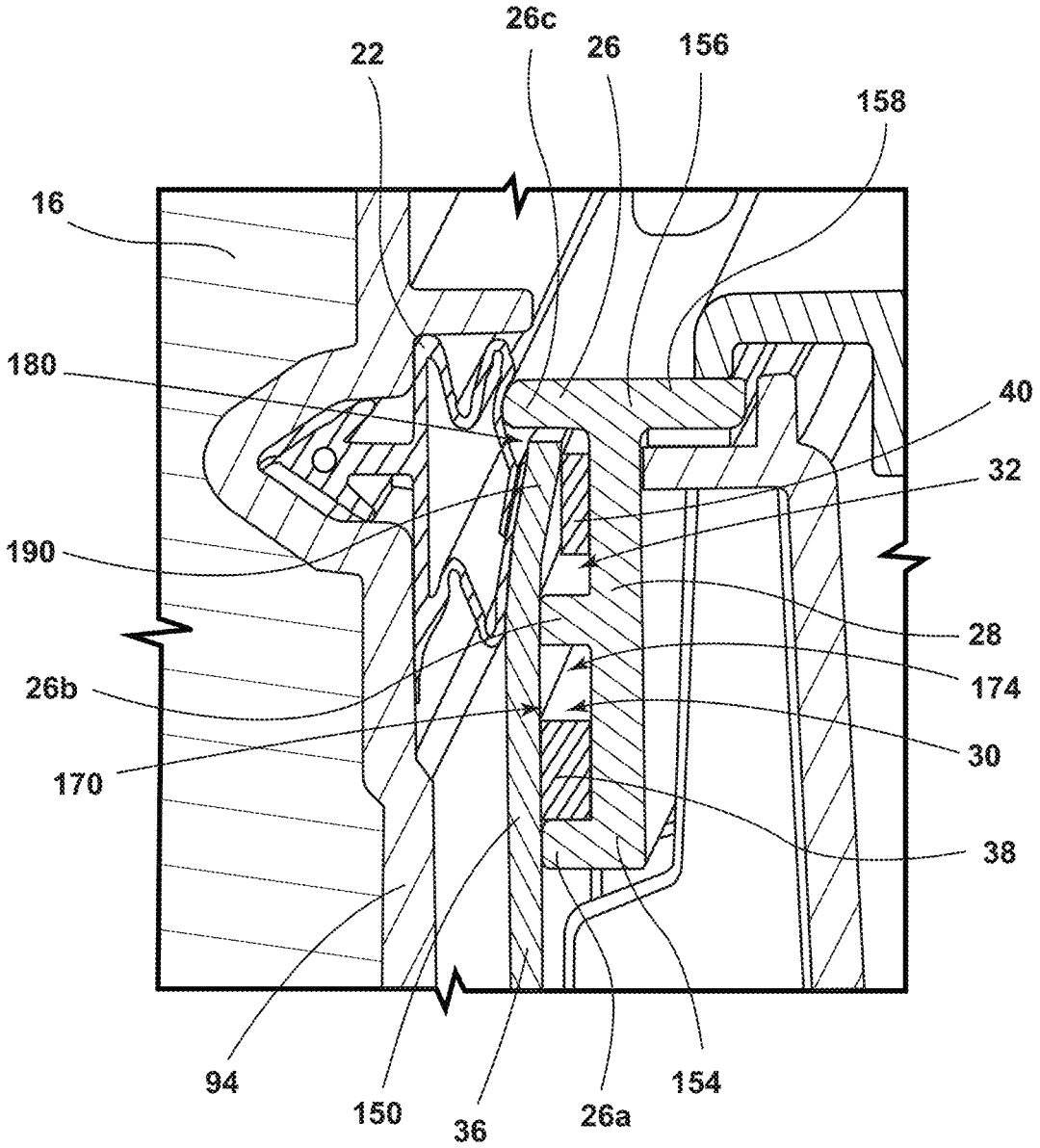
FIG. 7 is a cross-sectional view of a bottom portion of the ice-making appliance of FIG. 2 taken along line VII-VII.
Figure 8:
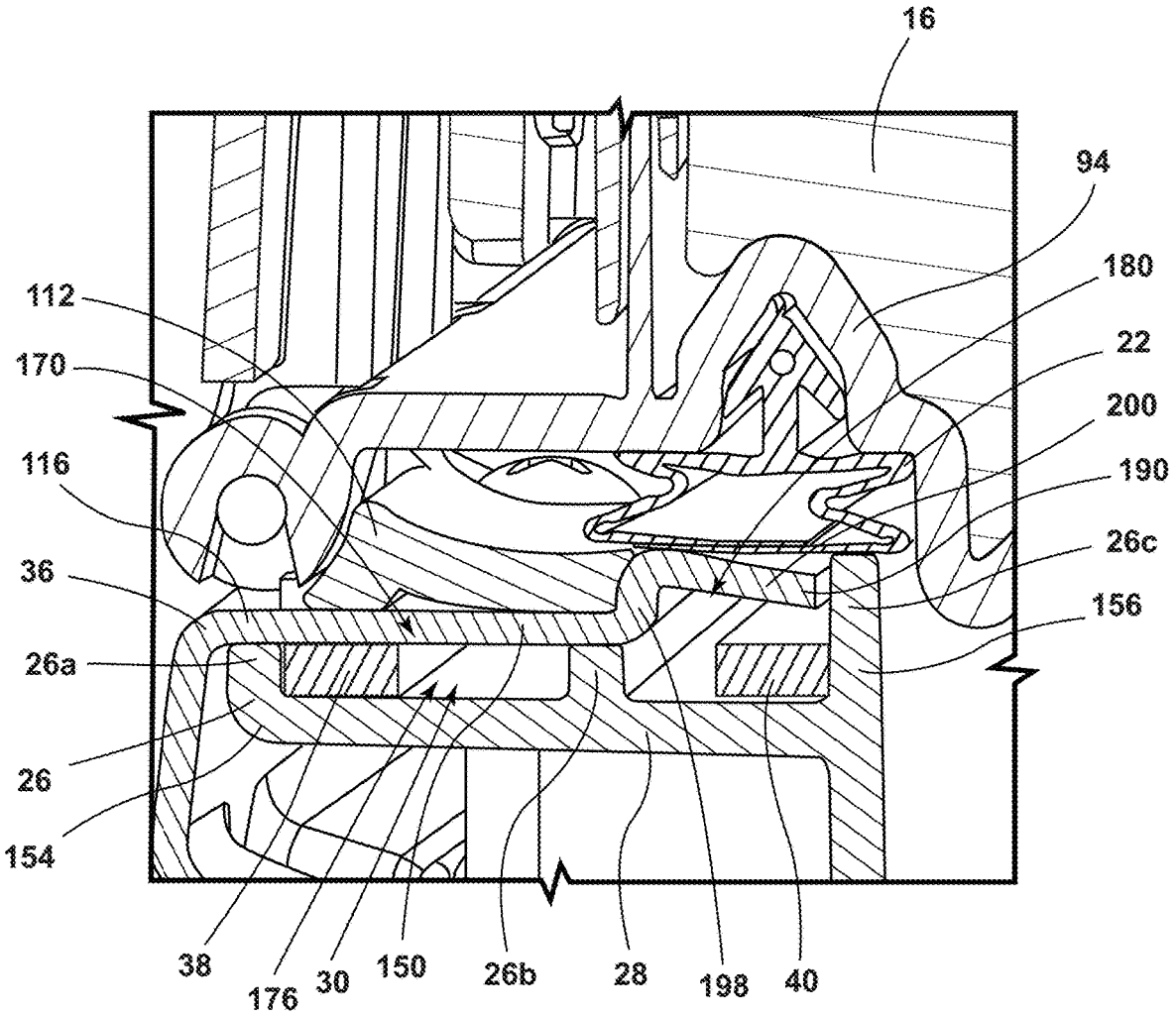
FIG. 8 is a cross-sectional view of a first side of the ice-making appliance of FIG. 2 taken along line VIII-VIII.
Figure 9:
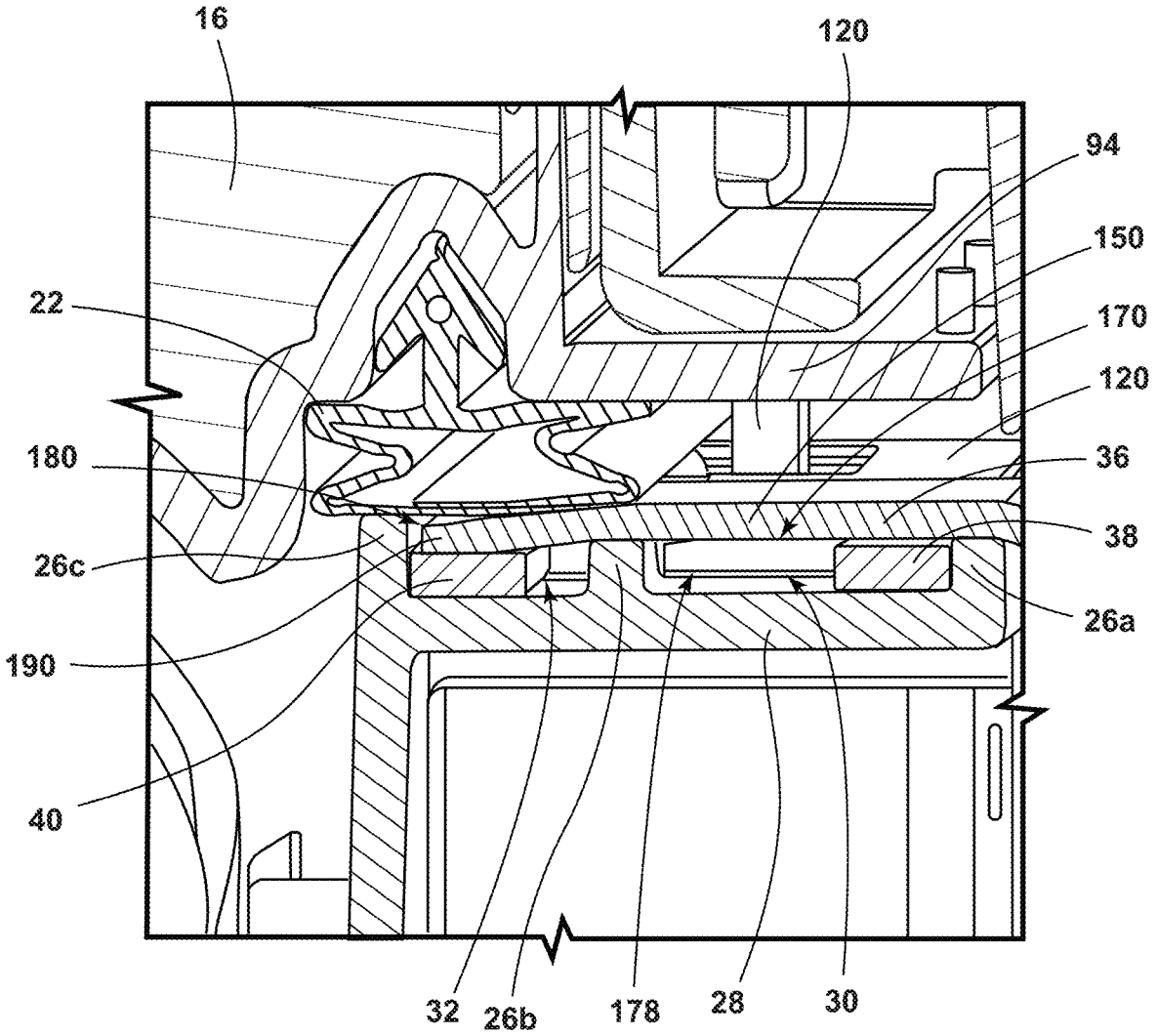
FIG. 9 is a cross-sectional view of a second side of the ice-making appliance of FIG. 2 taken along line IX-IX.

Referring now to FIGS. 5-9, the plurality of protrusions 26 may extend from the box rim 28 outward of the icemaker 10. FIG. 5 shows the box rim 28 having the plurality of protrusions 26. FIG. 6 shows a cross-section taken along the upper wall 130 of the icemaker box 14. Similarly, FIGS. 7, 8, and 9 show cross-sections taken along the lower wall 132, the first sidewall 136, and the second sidewall 238 of the icemaker box 14, respectively. The plurality of protrusions 26 may include a first protrusion 26*a*, a second protrusion 26*b*, and third protrusion 26*c*. The first protrusion 26*a* may be positioned proximate the outer edge 154 of the box rim 28. Similarly, the third protrusion 26*c* may be position proximate the inner edge 156 of the box rim 28. The second protrusion 26*b* may be positioned between the first protrusion 26*a* and the second protrusion 26*c*. Each of the plurality of protrusions 26 may extend the length of the box rim 28 and may be continuous. Each of the plurality protrusions 26 further may have a generally rectangular cross-section. However, it will be understood that each of the plurality of protrusions 26*a*, 26*b*, 26*c* may have a cross-section that may be curvilinear, triangular, or otherwise shaped.

According to various examples, the plurality of protrusions 26 may have varying height measured from box rim 28. For example, the first protrusion 26*a* may have a first height measured from box rim 28, and the second protrusion 26*b* may have a second height measured from the box rim 28. The first height may be greater than the second height. Likewise, the third protrusion 26*c* may have a third height measured from the box rim 28. The third height may be less than the second height. In other examples, one or more of the plurality of protrusions 26 may have the same height, for example, the second height may be the same as the third height. According to various examples, the height of each of the plurality of protrusions 26*a*, 26*b*, 26*c* may be consistent along the length of the respective protrusion 26. In other examples, the height of the protrusions 26*a*, 26*b*, 26*c* may vary dependent on the wall 130, 132, 136, 138 of the icemaker box 14 the protrusion 26*a*, 26*b*, 26*c* is positioned proximate to. For example, the height of the first protrusion 26*a* may be greater proximate the upper wall 136 and lesser proximate the lower wall 138. In still other examples, the inner edge 156 of the box rim 28 may be formed with a foot 158 extending perpendicular to the box rim 28 along a portion of the box rim 28 (FIG. 7). Together with the box rim 28, the foot 158 defines a substantially T-shaped cross-section. Further, the third protrusion 26*c* may be integrally formed with the foot 158 so that an end of the foot 158 is formed of the third protrusion 26*c*.

Each of the plurality of protrusions 26 extending from the box rim 28 and at least one other of the plurality of protrusions 26 extending from the box rim 28 may define one of the first and second channels 30, 32. The first channel 30 may be defined by the first protrusion 26*a* extending from the box rim 28 and the second protrusion 26*b* extending from the box rim 28. The first channel 30 may be defined proximate the outer edge 154 of the box rim 28 and may include a first open end 170. The first channel 30 may have an upper portion 172 (FIG. 6), a lower portion 174 (FIG. 7), a first side portion 176 (FIG. 8), and a second side portion 178 (FIG. 9). The dimensions of the cross-section of the first channel 30 may vary between the portions 172, 174, 176, 178. For example, the upper portion 172 may have a larger cross-sectional area than the other portions 174, 176, 178. Similarly, the lower portion 174 may have a smaller cross-sectional area than the other portions 172, 176, 178. In other examples, the cross-sectional area of the first channel 30 may remain consistent throughout the first channel 30. It is also contemplated that any variation in cross-sectional area may occur without departing from the scope of the present disclosure.

Similarly, the second channel 32 may be defined by the second protrusion 26*b* extending from the box rim 28 and the third protrusion 26*c* extending from box rim 28. The second channel 32 may be positioned proximate the inner edge 156 of the box rim 28 and may include a second open end 180. The cross-sectional area of the second channel 32 may be consistent throughout. In other examples, the cross-sectional area of the second channel 32 may vary based on the location of the respective portion of the second channel 32.

The first and second open ends 170, 180 may be defined along a plane substantially parallel to the box rim 28 and the liner rim 150. Each of the first and second open ends 170, 180 may be defined by the respective protrusions 26*a*, 26*b*, 26*c*. The first and second open ends 170, 180 may further be covered by the liner rim 150 such that the first and second channels 30, 32 are fully enclosed when the liner rim 150 is positioned over the box rim 28 to be substantially flush with the box rim 28. When the liner rim 150 is positioned over the box rim 28, an inner surface of the liner rim 150 may abut the tops of the protrusions 26*a*, 26*b*, 26*c*. In some examples, a first edge 190 of the liner rim 150 may extend to the third protrusion 26*c* such that the first edge 190 extends at least partially into the second open end 180.

According to various examples, the plurality of protrusions 26 may define the first channel 30 and the second channel 32. In other examples, the plurality of protrusions 26 may define a single channel. Where the plurality of protrusions 26 defines the single channel, the first and second gaskets 38, 40 may be positioned within the single channel. In some examples, the gaskets 38, 40 may be spaced apart within the channel. In other examples, the gaskets 38, 40 may be positioned substantially flush within the channel.

Each of the first and second gasket 38, 40 may be made of a foam material, for example, Ethylene Propylene Diene Monome (EDPM) foam, neoprene foam, nitrile foam, silicone foam, etc. The first gasket 38 and the second gasket 40 may be coupled to the box rim 28 using adhesive or other bonding methods. According to various examples, each of the first gasket 38 and the second gasket 40 may have a generally rectangular cross-section. In other examples, each of the first gasket 38 and the second gasket 40 may have a cross-section that may be generally square, circular, oblong, or any other higher order polygon shape. It will be understood that the first gasket 38 and the second gasket 40 may differ in size and shape as well as material without departing from the scope of the present disclosure.

The first gasket 38 may be positioned within the first channel 30. In various examples, the first gasket 38 may be positioned substantially flush with the first protrusion 26*a*. In other examples, the first gasket 38 may be positioned substantially flush with the second protrusion 26*b*. In still other examples, the first gasket 38 may be positioned between the first and second protrusions 26*a*, 26*b*. The first gasket 38 may be shaped to maintain the position of the first gasket 38 relative to the protrusions 26*a*, 26*b* throughout the first channel 30. Alternatively, the first gasket 38 may be shaped to be positioned in various positions relative to the protrusions 26*a*, 26*b* depending on the portion 172, 174, 176, 178 of the first channel 30. For example, the first gasket 38 may be positioned substantially flush with the first protrusion 26*a* in the upper portion 172 but may be positioned between the first and second protrusions 26*a*, 26*b* in the other portions 174, 176, 178. It will be understood that any variation in positioning may be used where the first gasket 38 is coupled to the box rim 28 and positioned within the first channel 30. According to various examples, the first gasket 38 may extend along within the upper portion 172, one of the side portions 176, 178, and the lower portion 174 of the first channel 30. In other examples, the first gasket 38 may extend the entirety of the first channel 30, including upper portion 172, the lower portion 174, and the first and second side portions 176, 178.

Similarly, the second gasket 40 may be positioned within the second channel 32. According to various examples, the second gasket 40 may be positioned proximate the third protrusion 26*c*. In other examples, the second gasket 40 may be positioned proximate the second protrusion 26*b*. In still other examples, the second gasket 40 may substantially fill the second channel 32 such that the second gasket 40 may be substantially flush with both the second protrusion 26*b* and the third protrusion 26*c*. In other examples, the second gasket 40 may be positioned between the second protrusion 26*b* and the third protrusion 26*c*. The second gasket 40 may be shaped to maintain the positioning throughout the second channel 32. Alternatively, the second gasket 40 may be shaped to be positioned in various positions based on the location of the second gasket 40 within the second channel 32. The second gasket 40 and the edge 190 of the liner rim 150 may be positioned proximate the sealing gasket 22 of the icemaker door 16 when the icemaker door 16 is in a closed position.

The shape of the liner rim 150 may vary about the periphery of the box rim 28. As discussed elsewhere herein, the liner rim 150 may include the first edge 190. According to various examples, the first edge 190 of the liner rim 150 may abut the second gasket 40. In other examples, the first edge 190 may extend over the second gasket 40 and may abut the third protrusion 26*c*. Where the box rim 28 defines the first and second channels 30, 32 proximate the hinge 112, the liner rim 150 may include a lip 198 positioned proximate the first edge 190 of the liner rim 150. The lip 198 may extend upward substantially perpendicular to the liner rim 150 and may include a foot 200 extending perpendicular to the lip 198. The lip 198 and the foot 200 may be positioned substantially flush with the hinge 112 and the third protrusion 26*c* may be of a height to allow the first edge 190 of the liner rim 150 to substantially abut the third protrusion 26*c* at the end of the foot 200. In other words, the lip 198 and the foot 200 may form a corner portion, and one of the protrusions 26*a*, 26*b*, 26*c* may be positioned within the corner portion.

This contact between the first edge 190 of the liner rim 150 and the third protrusion 26*c* may reduce a direct conduction pathway that may cause condensation to form and freeze on the liner 36. By reducing the direct conduction pathway, the amount of condensation may be reduced. Further, the first and second gaskets 38, 40 may act to insulate the juncture between the box rim 28 and the liner rim 150 to provide added thermal resistance and to prevent air leakage. This may raise the temperature of the liner rim 150 to a temperature warmer than dew point, preventing condensation and frost.

Figure 10:
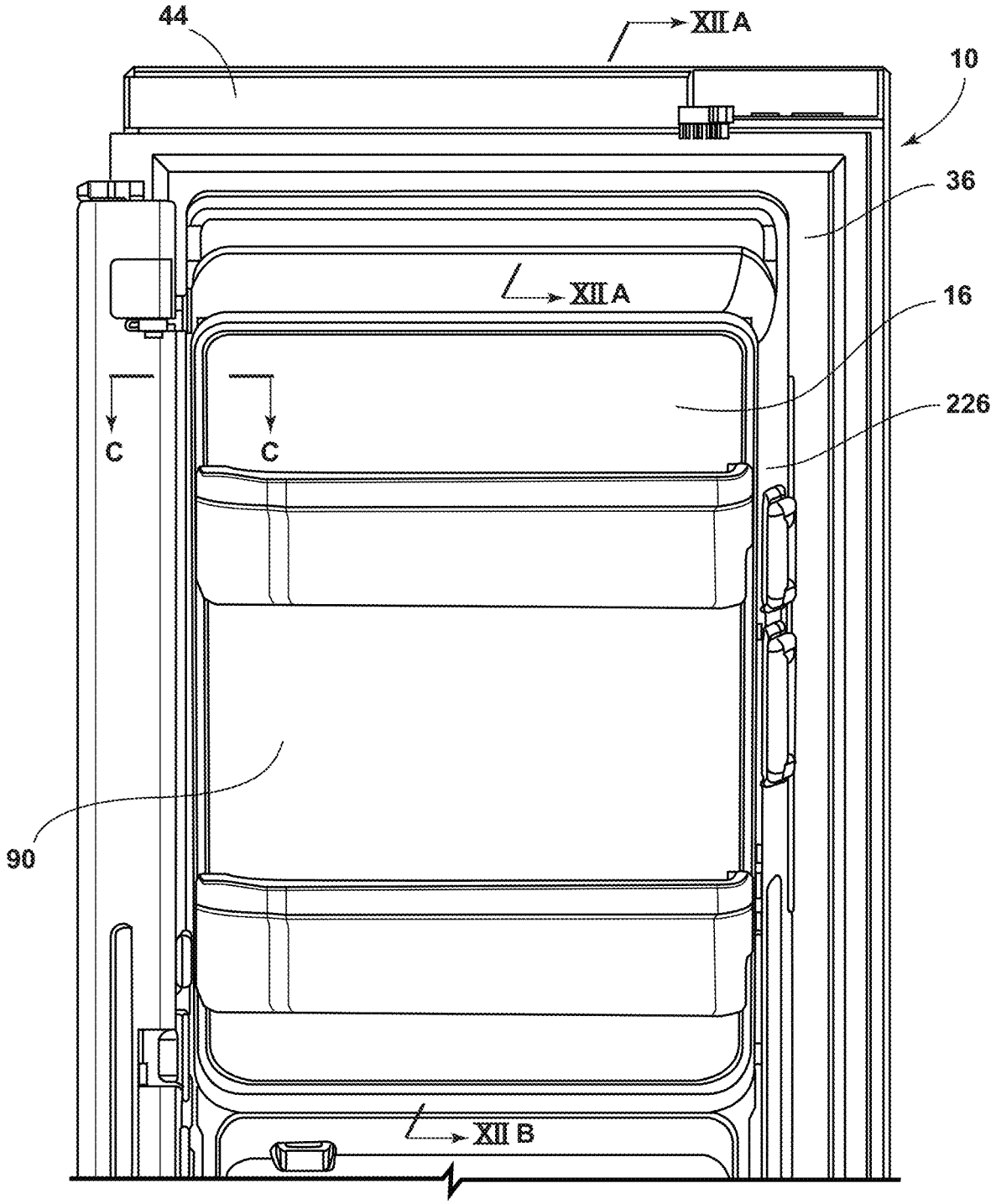
FIG. 10 is a rear profile view of an ice-making appliance positioned on an inner surface of a door of the refrigeration appliance of FIG. 1 with an icemaker door according to some examples.
Figure 11:
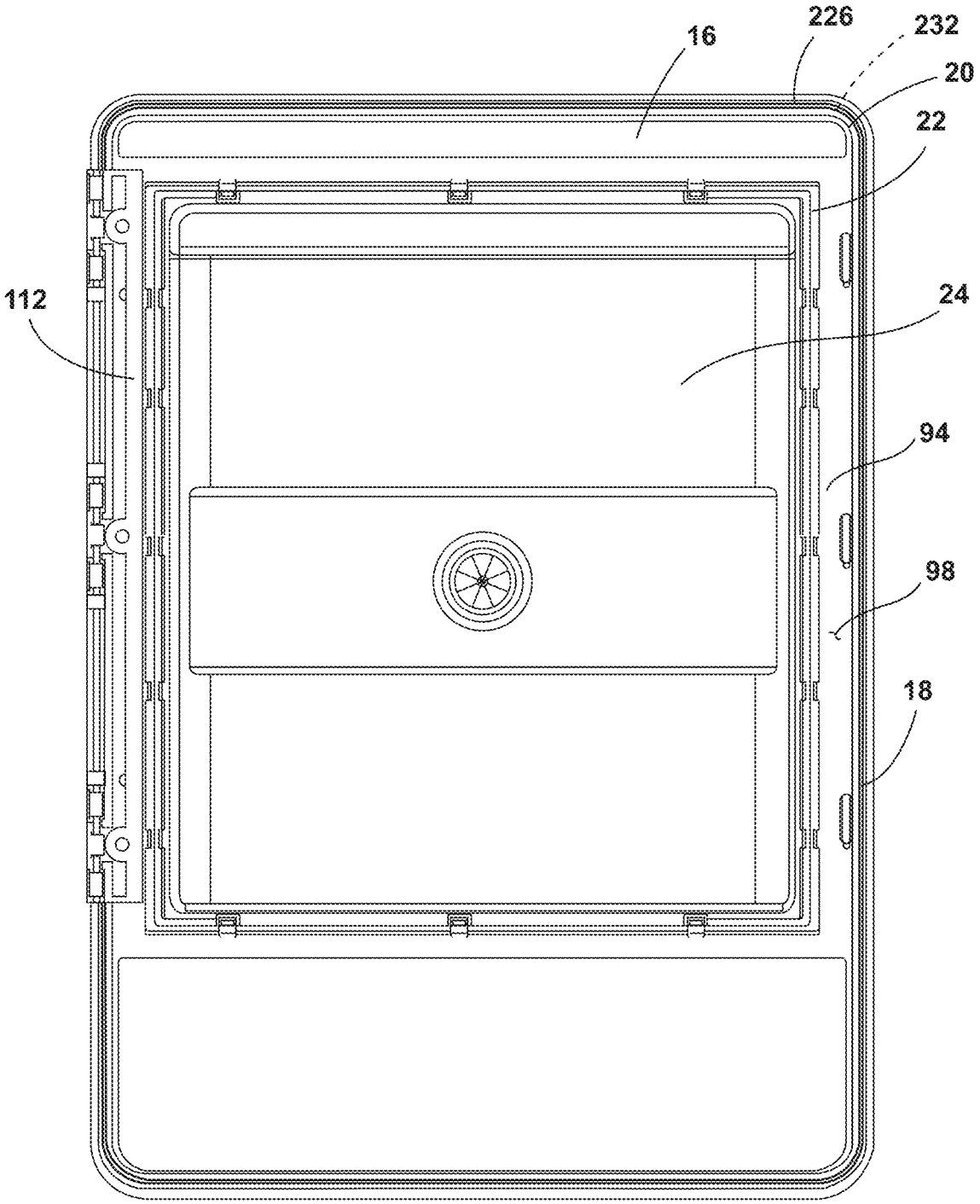
FIG. 11 is a front profile view of an inner surface of the icemaker door of FIG. 10

Referring now to FIGS. 10 and 11, the icemaker door 16 is shown in the open position (FIG. 10) and the closed position (FIG. 11). The icemaker door 16 may include the outer panel 90 and the inner panel 94, as discussed elsewhere herein. The icemaker door 16 may have the outer gasket 18 positioned about the periphery of the inner panel 94 of the icemaker door 16. The outer gasket 18 may complement the sealing gasket 22, facilitating a tighter seal between the icemaker door 16 and the liner 36. According to various examples, the outer gasket 18 may extend about the entire periphery of the inner panel 94. In other examples, the outer gasket 18 may extend about a portion of the periphery of the inner panel 94, such as from the top of the hinge 112 to the bottom of the hinge 112 (FIG. 11). The outer gasket 18 may be removably coupled to the icemaker door 16. Alternatively, the outer gasket 18 may be fixedly coupled to the icemaker door 16.

Figure 12A:
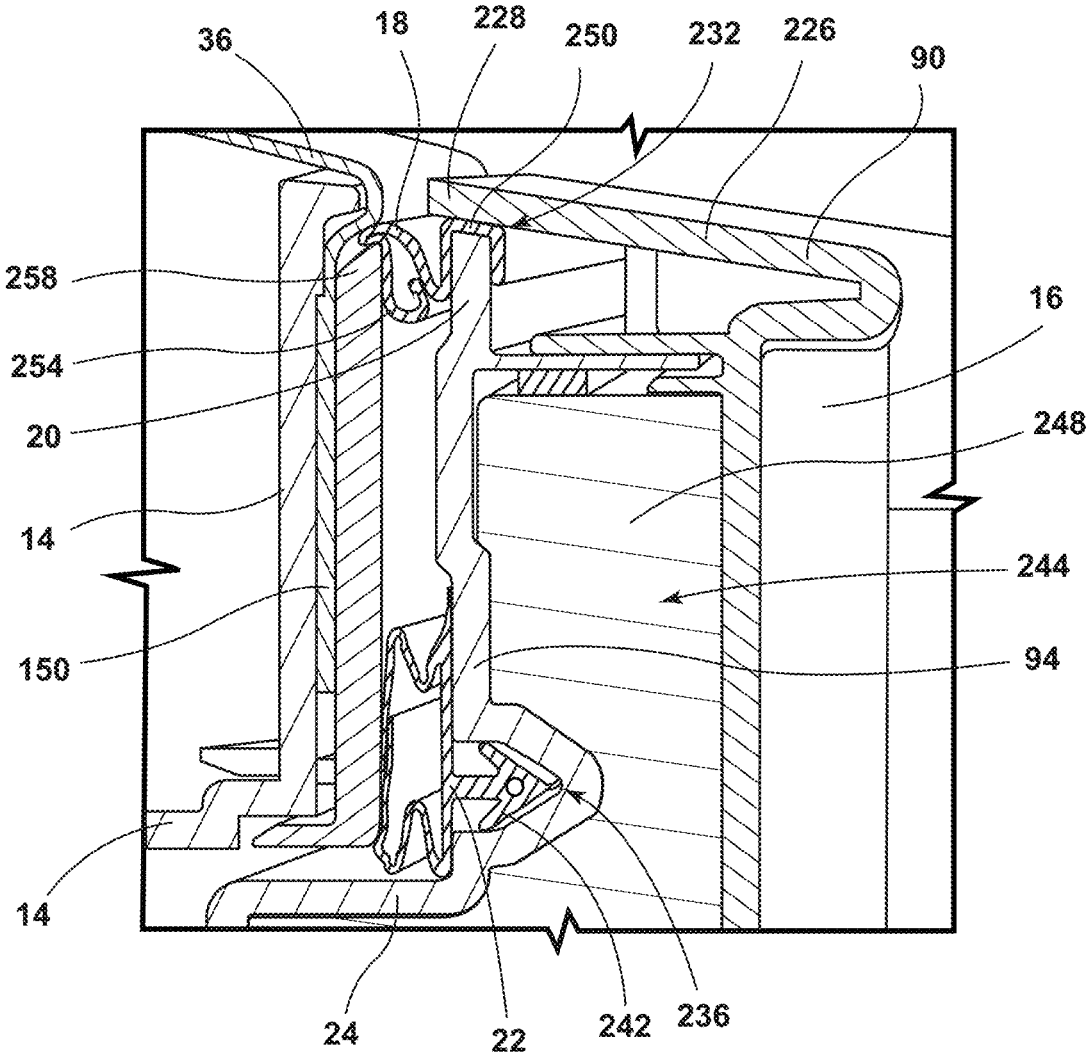
FIG. 12A is a cross-sectional view of a top of the ice-making appliance of FIG. 10 taken along line XIIA-XIIA with an exemplary gasket.
Figure 12B:
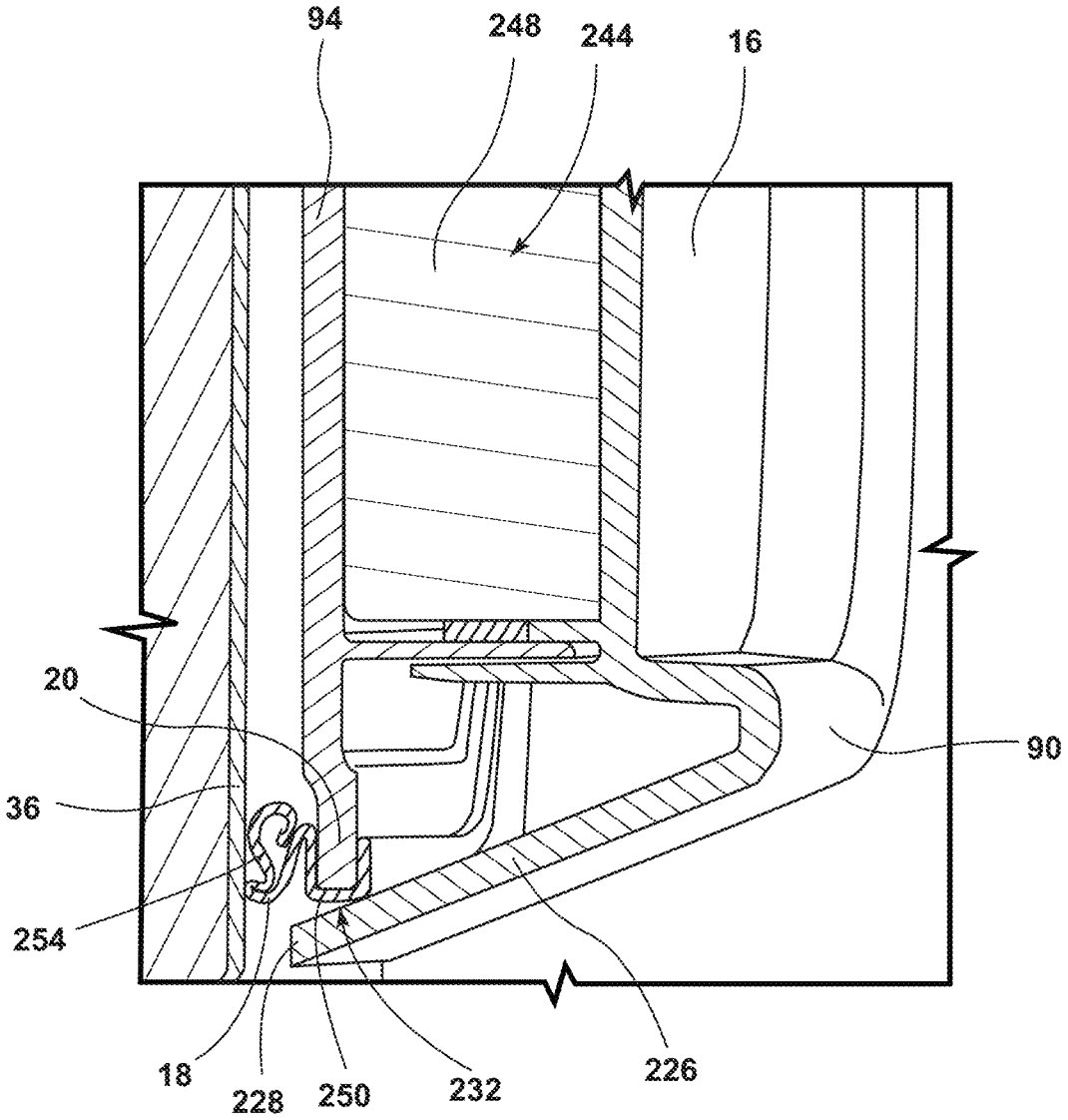
FIG. 12B is a cross-sectional view of a bottom of the ice-making appliance of FIG. 10 taken along line XIIB-XIIB with an exemplary gasket.

As shown in FIGS. 12A and 12B, cross-sections taken along an upper portion of the icemaker door 16 (FIG. 12A) and a lower portion of the icemaker door 16 (FIG. 12B) show the inner panel 94 coupled with the outer panel 90. The inner panel 94 may be at least partially received within an opening defined by the outer panel 90. The inner panel 94 may include an inner surface 98 of the icemaker door 16. The inner edge 20 surrounds the inner surface 98 and extends about the periphery of the inner panel 94. The inner edge 20 of the inner panel 94 may be positioned proximate an outer wall 226 of the outer panel 90 of the icemaker door 16. An end 228 of the outer wall 226 of the outer panel 90 of the icemaker door 16 and the inner edge 20 of the inner panel 94 may define a gap 232. In various examples, the outer gasket 18 may be at least partially positioned within the gap 232. According to other examples, a slot 316 (FIG. 14C) or a channel 366 (FIG. 15C) may be defined through the inner surface 98 proximate the inner edge 20 to at least partially receive the outer gasket 18.

Referring still to FIGS. 12A and 12B, the inner surface 98 of the inner panel 94 may further define a channel 236 for coupling the sealing gasket 22 with the inner panel 94 of the icemaker door 16. The channel 236 may be shaped to complement an anchor 242 of the sealing gasket 22. According to various examples, the sealing gasket 22 may be fixedly coupled with the inner panel 94 of the icemaker door 16. In other examples, the sealing gasket 22 may be removably coupled with the inner panel 94 of the icemaker door 16. The channel 236 may be defined proximate the central portion 24 of the icemaker door 16 such that the sealing gasket 22 may substantially abut the central portion 24 when the anchor 242 of the sealing gasket 22 is received by the channel 236. Alternatively, the channel 236 may be defined spaced away from the central portion 24 such that the sealing gasket 22 may be positioned between the inner edge 20 of the inner panel 94 and the central portion 24 when the anchor 242 of the sealing gasket 22 is received by the channel 236. It will be understood that the sealing gasket 22 may extend about the entirety of the central portion 24 or only a portion of the central portion 24 without departing from the scope of the present disclosure.

The inner panel 94 of the icemaker door 16 may be coupled to the outer panel 90 of the icemaker door 16, as discussed elsewhere herein. Together, the inner panel 94 and the outer panel 90 of the icemaker door 16 define a cavity 244. The cavity 244 may be filled with insulation material 248, according to various examples. The insulation material 248 may be configured to help insulate the icemaker 10 when the icemaker door 16 is in a closed position.

Referring now to FIGS. 12A and 12B, the outer gasket 18 may have a linear connecting portion 250 and a non-linear contact portion 254. In various examples, the connecting portion 250 may be received by the gap 232 defined between the end 228 of the outer wall 226 of the outer panel 90 and the inner edge 20 of the inner panel 94 of the icemaker door 16. In other examples, the connecting portion 250 may be received by the slot 316 (FIG. 14C) or the channel 366 (FIG. 15C) defined by the inner edge 20 of the inner panel 94.

According to various examples, the non-linear contact portion 254 may be positioned to abut a trim piece 258. The trim piece 258 may extend over the liner rim 150 of the door liner 36 and may be configured to seal the joinder of the icemaker box 14 and the door liner 36. In other examples, the non-linear contact portion 254 may be configured to abut the liner rim 150 of the door liner 36. When the non-linear contact portion 254 abuts the trim piece 258 or the liner rim 150 or any other portion of the icemaker 10, the non-linear contact portion 254 may be compressed, as shown in FIGS. 12A and 12B.

Figure 13A:
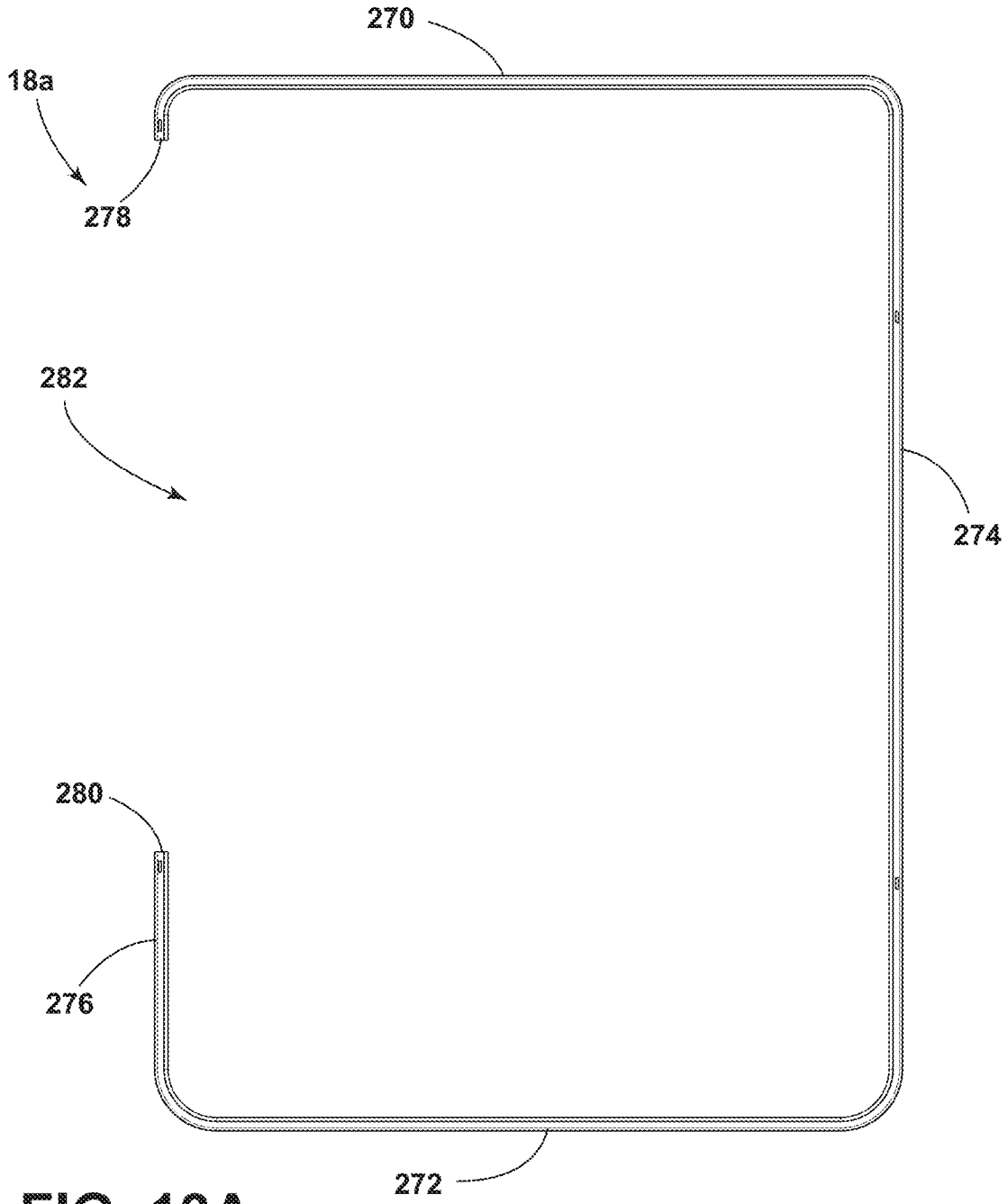
FIG. 13A is a gasket according to various examples.
Figure 13B:
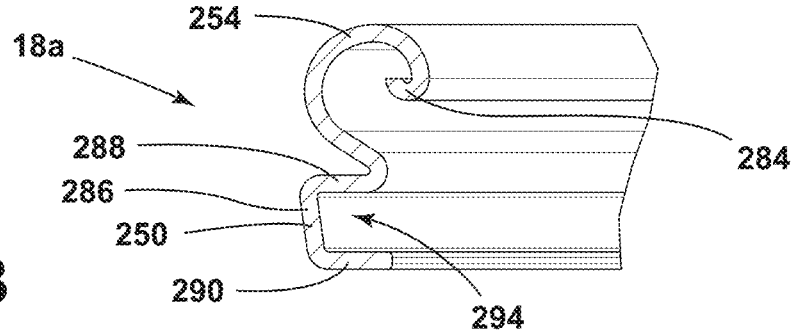
FIG. 13B is a cross-sectional view of the gasket taken along line XIIIB-XIIIB of FIG. 13A.
Figure 13C:
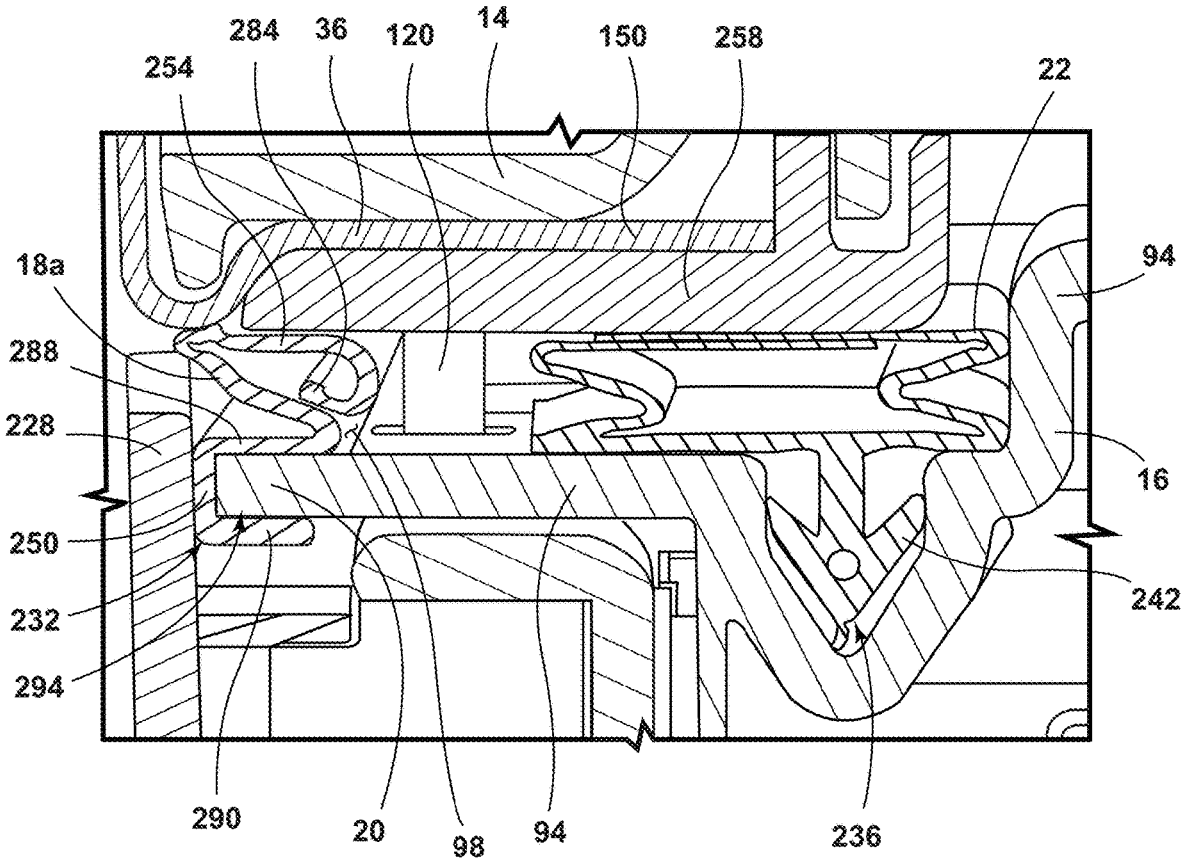
FIG. 13C is a cross-sectional view of the gasket of FIG. 13A within the ice-making appliance taken along line C-C of FIG. 10.

Referring now to FIGS. 13A-13C, a first outer gasket 18*a* is shown having the connecting portion 250 and the contact portion 254, according to various examples. The first outer gasket 18*a* may include a top portion 270 and a bottom portion 272. A first side portion 274 may connect the top portion 270 and the bottom portion 272. In some examples, a second side portion 276 may extend between the top portion 270 and the bottom portion 272 opposite the first side portion 274. The second side portion 276 may include a space 282 defined by an upper end 278 and a lower end 280 of the second side portion 276. The space 282 may be sized to receive the hinge 112, and the upper and lower ends 278, 280 may be positioned to abut the hinge 112 when the outer gasket 18*a* is installed within the gap 232 of the icemaker door 16 (FIG. 11).

As shown in FIGS. 13B and 13C, the connecting portion 250 may include a sidewall 286, an upper wall 288, and a lower wall 290. When the gasket 18*a* is received by the gap 232, the connecting portion 250 may be engaged with the inner edge 20 of the inner panel 94 of the icemaker door 16. The sidewall 286 may be positioned within the gap 232 and may substantially contact an end surface of the inner edge 20 of the inner panel 94 of the icemaker door 16. The sidewall 286, the upper wall 288, and the lower wall 290 together form a space 294 configured to receive the inner edge 20 of the inner panel 94 of the icemaker door 16 such that the upper wall 288 is substantially flush with the inner surface 98 of the inner panel 94 of the icemaker door 16. The lower wall 290 should likewise be positioned substantially flush with a bottom surface of the inner panel 94 of the icemaker door 16.

The contact portion 254 may be generally curved such that an outer edge 284 may be compressed when the contact portion 254 contacts the liner rim 150 or the trim piece 258. The outer edge 284 may be curved inward toward a center of the contact portion 254. In various examples, the contact portion 254 may have a hook-shaped cross-section. In other examples, the contact portion 254 may have a generally circular cross-section, an oblong cross-section, an arched cross-section with linear ends, or any other shape that provides a curved outer edge that may be compressed. In still other examples, the contact portion 254 may be at least partially linear and compressible, for example, having a square, rectangular, oblong, or any other higher order polygon cross-section.

Figure 14A:
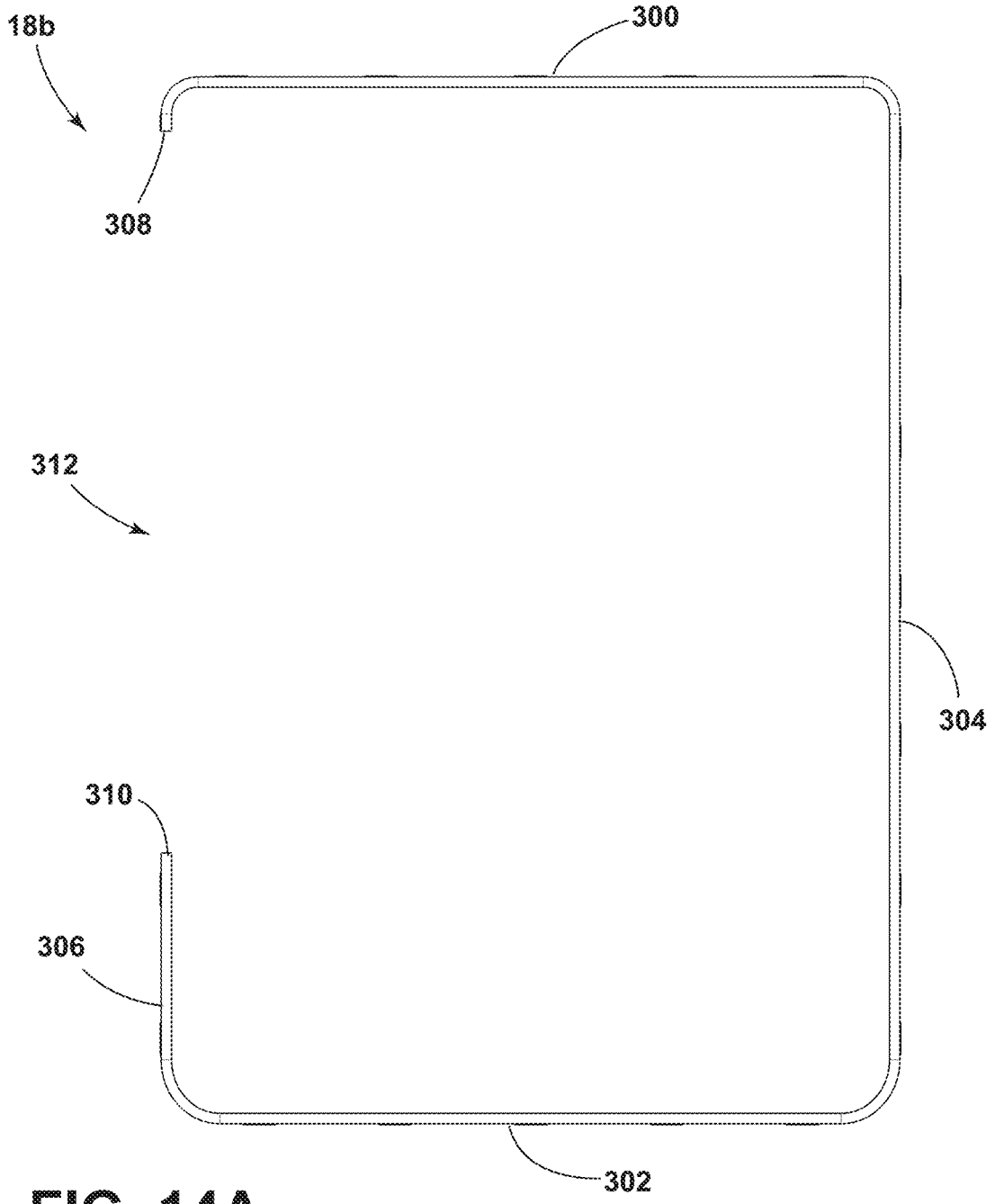
FIG. 14A is a gasket according to various examples.
Figure 14B:
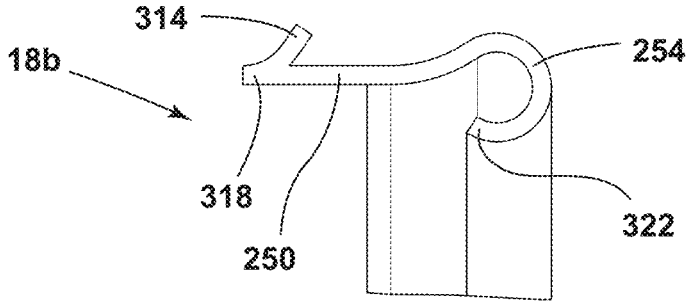
FIG. 14B is a cross-sectional view of the gasket taken along line XIVB-XIVB of FIG. 14A.
Figure 14C:
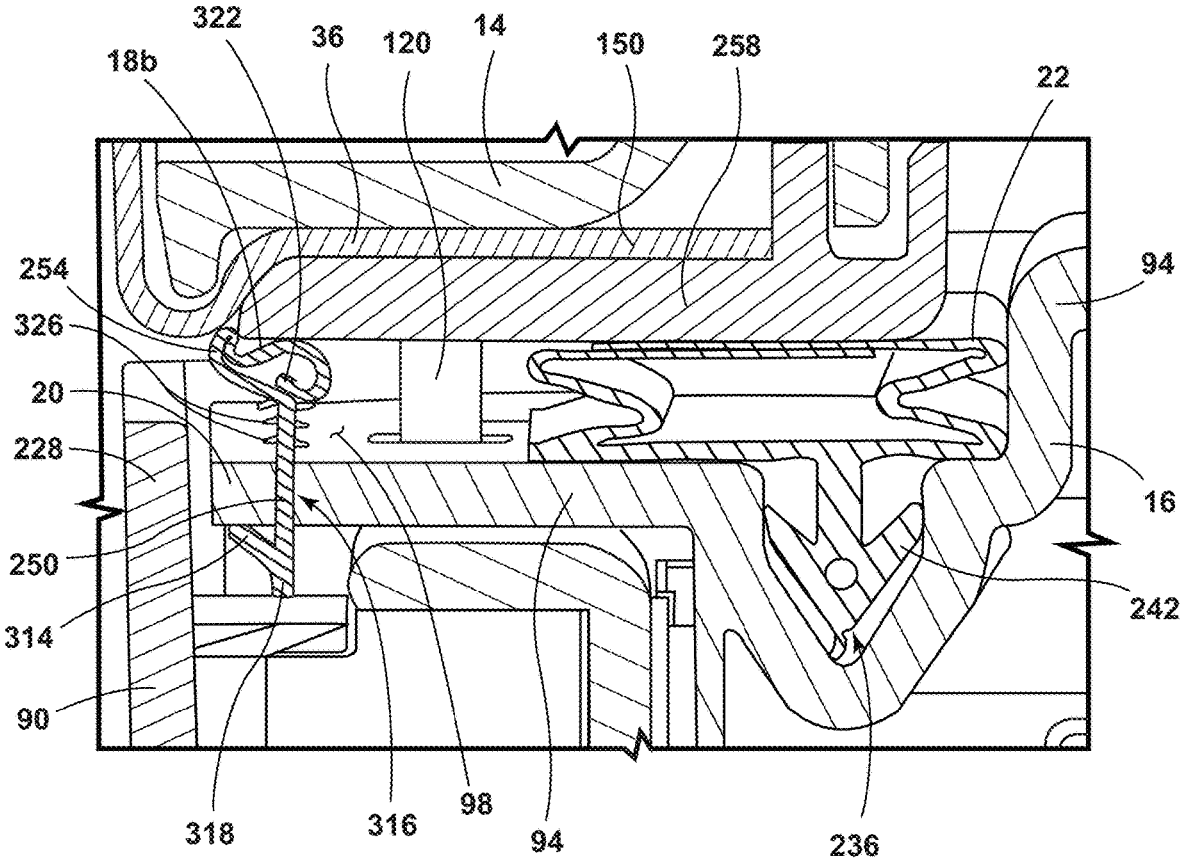
FIG. 14C is a cross-sectional view of the gasket of FIG. 14A within the ice-making appliance taken along line C-C of FIG. 10.

Referring now to FIGS. 14A-14C, a second outer gasket 18*b* is shown having the connecting portion 250 and the contact portion 254, according to various examples. The second outer gasket 18*b* may include a top portion 300 and a bottom portion 302. A first side portion 304 may connect the top portion 300 and the bottom portion 302. In some examples, a second side portion 306 may extend between the top portion 300 and the bottom portion 302 opposite the first side portion 304. The second side portion 306 may include a space 312 defined by an upper end 308 and a lower end 310 of the second side portion 306. The space 312 may be sized to receive the hinge 112, and the upper and lower ends 308, 310 may be positioned to abut the hinge 112 when the outer gasket 18*b* is installed within the gap 232 of the icemaker door 16 (FIG. 11).

As shown in FIGS. 14B and 14C, the connecting portion 250 of the second outer gasket 18*b* may be a generally linear member. An anchor 314 may be coupled to an end 318 of the connection portion 250. The connecting portion 250 of the outer gasket 18*b* may be configured to be received by the slot 316 defined by the inner panel 94 of the icemaker door 16. The connecting portion 250 may be installed through the slot 316 such that the anchor 314 abuts a bottom surface of the inner edge 20 of the inner panel 94 of the icemaker door 16. The contact between the bottom surface of the inner edge 20 of the inner panel 94 and the anchor 314 prevents inadvertent removal of the outer gasket 18*b* from the slot 316.

The connecting portion 250 may further include a plurality of ribs 326 extending outward from the connecting portion 250. The ribs 326 may abut the inner surface 98 of the inner panel 94 of the icemaker door 16 when the outer gasket 18*b* is received by the slot 316. In various examples, the ribs 326 may be aligned in pairs on opposing sides of the connecting portion 250. In other examples, the ribs 326 may be staggered on opposing sides of the connecting portion 250. Further, the ribs 326 may extend the length of the second outer gasket 18*b*. Alternatively, the ribs 326 may extend only partially along the length of the second outer gasket 18*b*. It will be understood that the ribs 326 may be arranged in any pattern and for any length of the outer gasket 18*b* without departing from the scope of the present disclosure.

The contact portion 254 may be generally curved such that an outer edge 322 may be compressed when the contact portion 254 contacts the liner rim 150 or the trim piece 258. The outer edge 322 may be curved inward toward a center of the contact portion 254. In various examples, the contact portion 254 may have a hook-shaped cross-section. In other examples, the contact portion 254 may have a generally circular cross-section, an oblong cross-section, an arched cross-section with linear ends, or any other shape that provides a curved outer edge that may be compressed. In still other examples, the contact portion 254 may be at least partially linear and compressible, for example, having a square, rectangular, oblong, or any other higher order polygon cross-section.

Figure 15A:
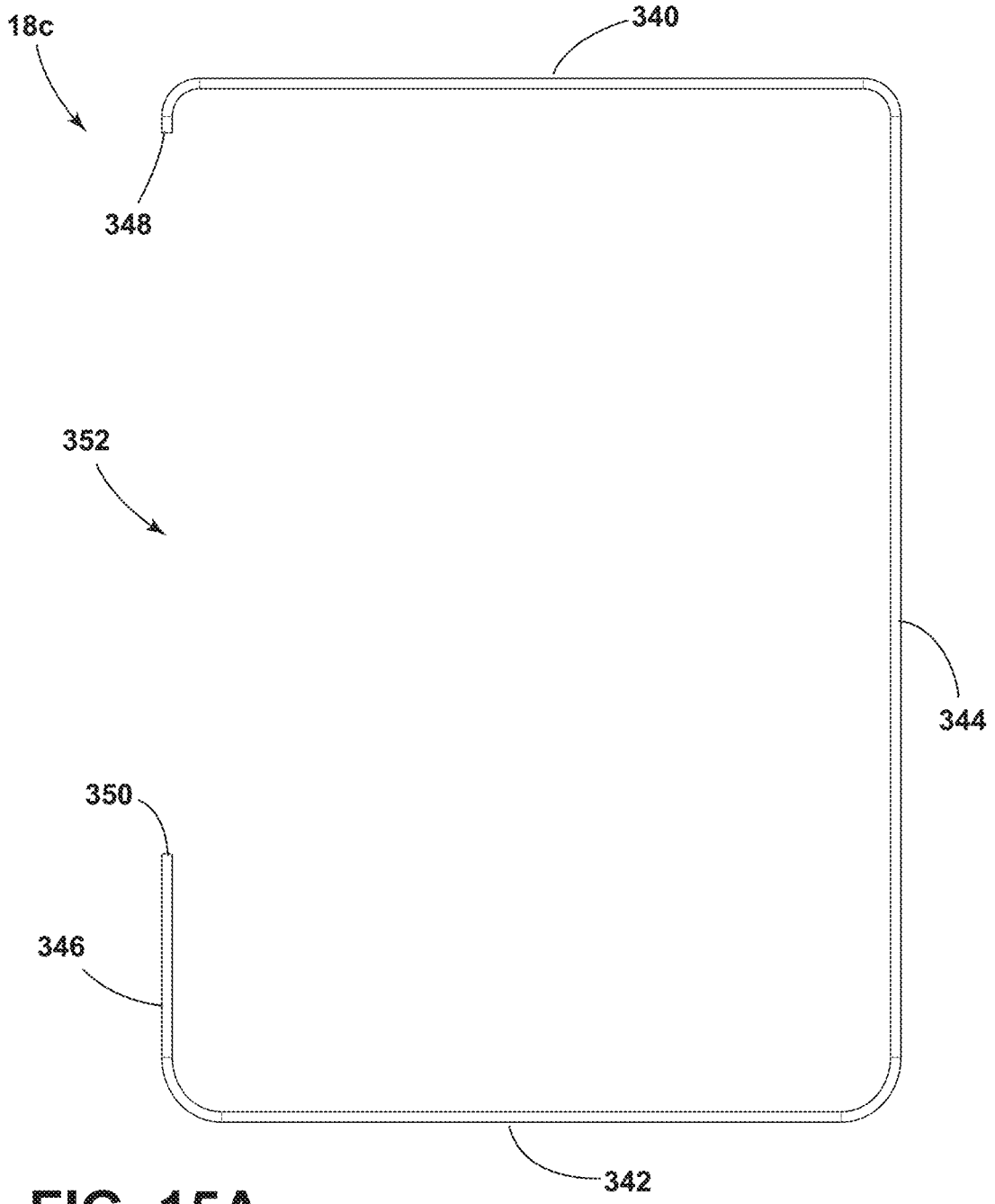
FIG. 15A is a gasket according to various examples.
Figure 15B:
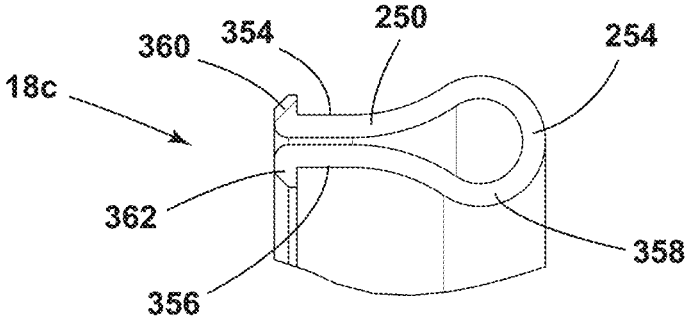
FIG. 15B is a cross-sectional view of the gasket taken along line XVB-XVB of FIG. 15A.
Figure 15C:
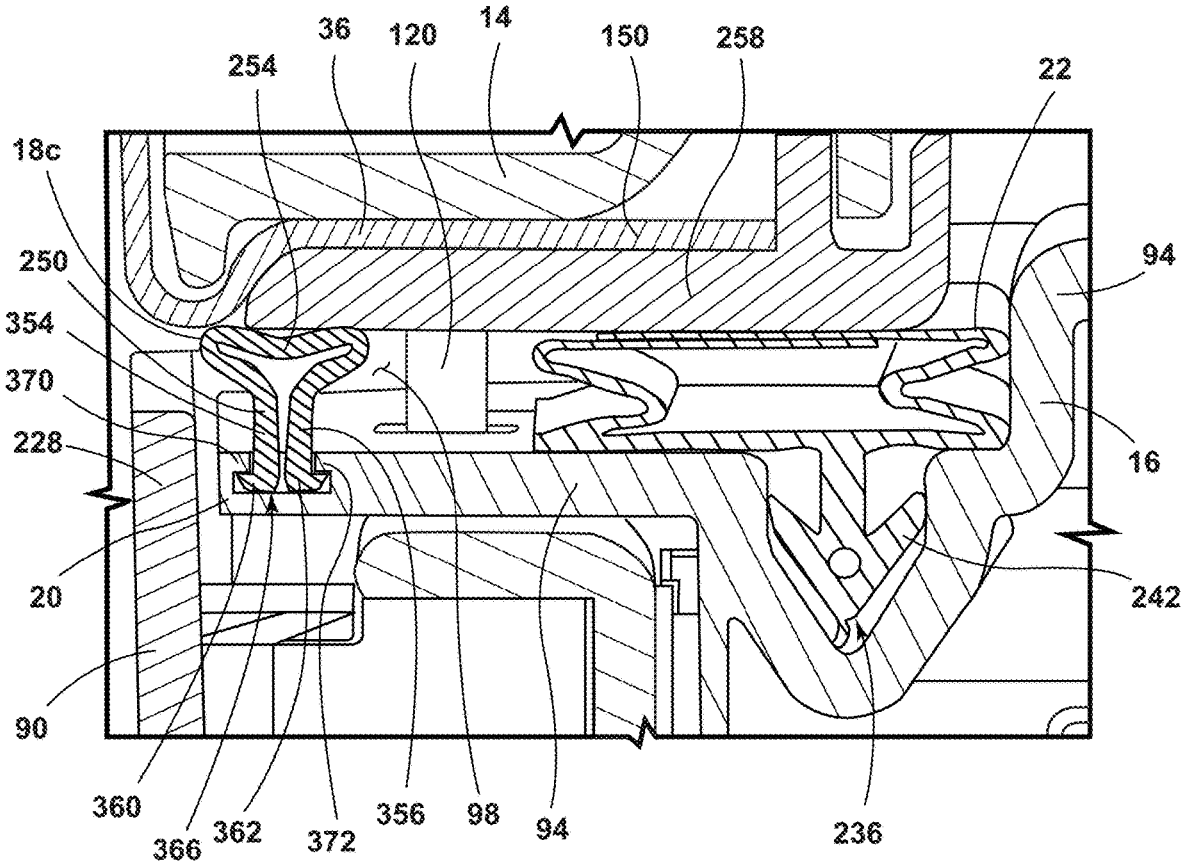
FIG. 15C is a cross-sectional view of the gasket of FIG. 15A within the ice-making appliance taken along line C-C of FIG. 10.

Referring now to FIGS. 15A-15C, a third outer gasket 18*c* is shown having the connecting portion 250 and the contact portion 254, according to various examples. The third outer gasket 18*c* may include a top portion 340 and a bottom portion 342. A first side portion 344 may connect the top portion 340 and the bottom portion 342. In some examples, a second side portion 346 may extend between the top portion 340 and the bottom portion 342 opposite the first side portion 344. The second side portion 346 may include a space 352 defined by an upper end 348 and a lower end 350 of the second side portion 346. The space 352 may be sized to receive the hinge 112, and the upper and lower ends 348, 350 may be positioned to abut the hinge 112 when the outer gasket 18*c* is installed within the gap 232 of the icemaker door 16 (FIG. 11).

As shown in FIGS. 15B and 15C, the connecting portion 250 of the third outer gasket 18*c* may be formed of first and second ends 354, 356 of the third outer gasket 18*c*. The first end 354 may be positioned parallel to the second end 356 such that a central portion 358 of the third gasket 18*c* forms the contact portion 254. In various examples, the first end 354 may be coupled to the second end 356. In other examples, the second end 356 may be integrally formed with the second end 356. The first and second ends 354, 356 of the third outer gasket 18*c* include a first foot 360 and a second foot 362, respectively. The first and second feet 360, 362 extend outwardly from and substantially perpendicular to the first and second ends 354, 356, respectively.

The connecting portion 250 may be configured to be received by the channel 366 defined by the inner edge 20 of the inner panel 94. The channel 366 includes first and second extensions 370, 372 extending parallel to the inner surface 98 of the inner panel 94 of the icemaker door 16. The first and second extensions 370, 372 extend over opposing sides of the channel 366. When the connecting portion 250 is positioned within the channel 366, the first foot 360 may be secured beneath the first extension 370, and the second foot 362 may be secured beneath the second extension 372. The first and second ends 354, 356 extend between the first and second extensions 370, 372. The contact between the first and second feet 360, 362 and the first and second extensions 370, 372, respectively, prevents inadvertent removal of the third outer gasket 18*c* from the channel 366.

The contact portion 254 may be generally curved such that the central portion 358 may be compressed when the contact portion 254 contacts the liner rim 150 or the trim piece 258. In various examples, the contact portion 254 may have a circular, oblong, or tear-drop shaped cross-section. In other examples, the contact portion 254 may be at least partially linear and compressible, for example, having a square, rectangular, oblong, or any other higher order polygon cross-section.

The use of the outer gasket 18 may prevent air recirculation between the top and bottom of the icemaker door 16 and the door liner 36. Because of the freezing temperatures within the cavity 142 defined by the icemaker box 14 and the lower temperatures within the refrigerator compartment 50, water may condense on the icemaker door 16 and freeze to form frost. The outer gasket 18 fits between in the outer panel 90 and the inner panel 94 to function as a secondary seal to prevent air from entering through the gap 232 and becoming stagnant and/or forming frost within the icemaker door 16.

Figure 16:
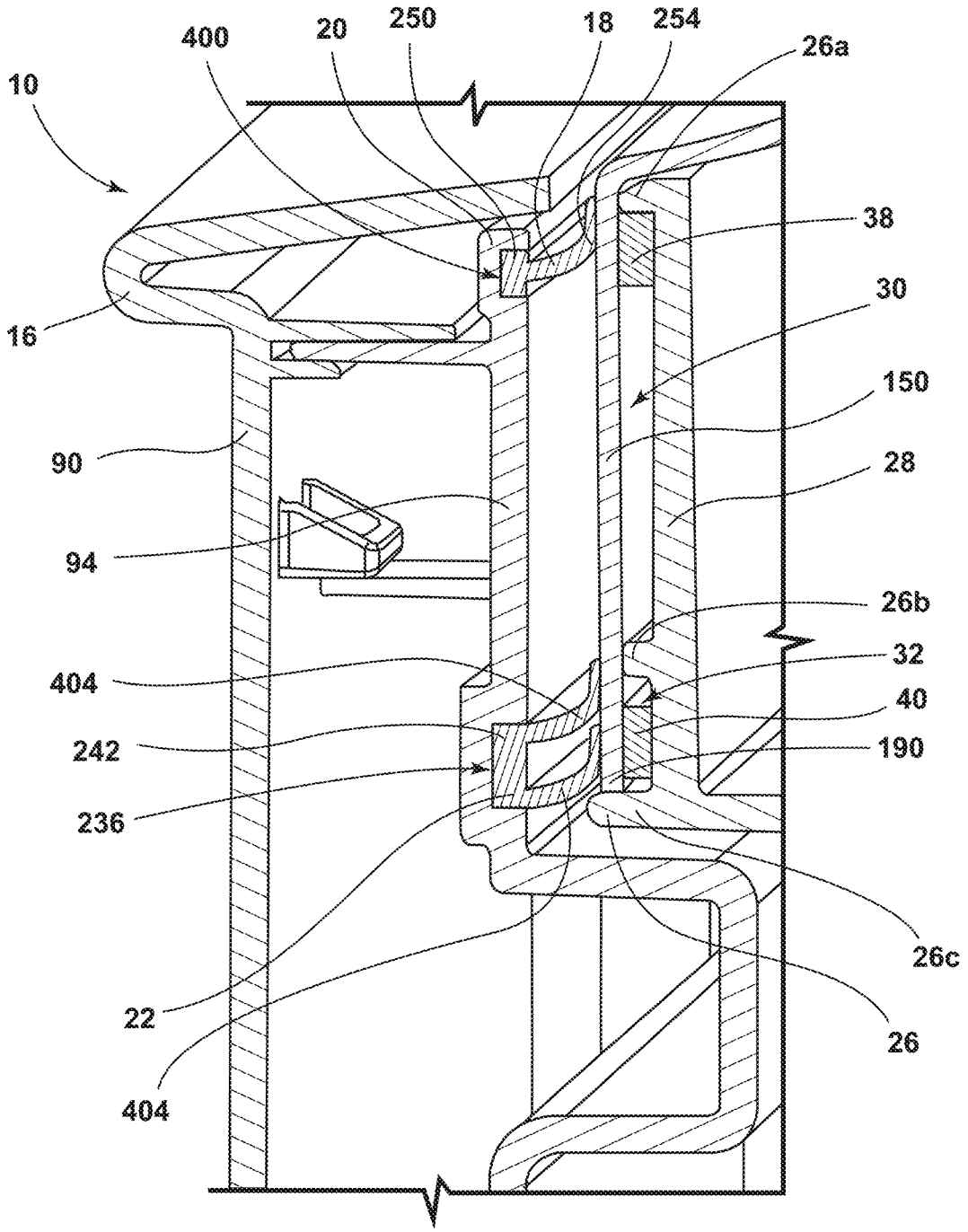
FIG. 16 is a cross-sectional view of a top of the ice-making appliance of FIG. 10, according to some exmaples.

Referring now to FIG. 16, the icemaker 10 may include both the first and second gaskets 38, 40 positioned within the first and second channels 30, 32 of the box rim 28 used in conjunction with the sealing gasket 22 and the outer gasket 18 of the icemaker door 16. According to various examples, the inner edge 20 of the inner panel 94 may define a channel 400. The channel 400 may have a cross-sectional shape that is circular, oblong, oval, square, rectangular, triangular, or shaped as any other higher order polygon. The channel 400 may be shaped to complement the shape of the connecting portion 250 of the outer gasket 18. The connecting portion 250 may be shaped as an anchor for the outer gasket 18. The connecting portion 250 may be coupled with the inner edge 20 within the channel 400 using, for example, adhesive.

The contact portion 254 of the outer gasket 18 may extend outward from the connecting portion 250. According to various examples, the contact portion 254 may extend linearly outward from the connecting portion 250 and away from the inner panel 94 of the icemaker door 16. The contact portion 254 may be substantially straight. Alternatively, the contact portion 254 may be substantially linear with a slight arc. In other examples, the contact portion 254 may extend non-linearly outward from the connecting portion 250. The contact portion 254 may be configured to deform when the contact portion 254 abuts the liner rim 150. When the contact portion 254 deforms, the contact portion 254 may curve away from the liner rim 150 back towards the inner panel 94 of the icemaker door 16.

Still referring to FIG. 16, the channel 236 may have a substantially rectangular or square cross-section in various examples. The channel 236 may be shaped to complement the shape of the anchor 242 of the sealing gasket 22, as discussed elsewhere herein. The anchor 242 of the sealing gasket 22 may be rectangular or square, according to various examples. The anchor 242 may further include at least one arm 404 extending from the anchor 242 outwardly and away from the inner panel 94 of the icemaker door 16. The at least one arm 404 may include a pair of arms 404 that are positioned parallel to one another. Each of the arms 404 may extend linearly outward from anchor 242 and away from the inner panel 94 of the icemaker door 16. Each of the arms 404 may be substantially straight. Alternatively, each of the arms 404 may be substantially linear with a slight arc. In other examples, each of the arms 404 may extend non-linearly outward from the anchor 242. Each of the arms 404 may be configured to deform when the arm 404 abuts the liner rim 150. When each of the arms 404 deforms, the respective arm 404 may curve away from the liner rim 150 back towards the inner panel 94 of the icemaker door 16.

It will be understood that any of the first outer gasket 18*a*, the second outer gasket 18*b*, and the third outer gasket 18*c* may be used as the outer gasket 18. It will also be understood that the inner edge 20 of the inner panel 94 may define one or more of the gap 232, the slot 316, and the channel 366 without departing from the scope of the present disclosure. Further, it is contemplated that any of the outer gaskets 18*a*, 18*b*, 18*c*, any shape of sealing gasket 22, and the first and second gaskets 38, 40 within the box rim 28 may be used in conjunction or separately and that any combination of the gaskets 18, 22, 38, 40 may be used without departing from the scope of the present disclosure.

According to one aspect, an icemaker for a refrigerator appliance may be provided. The icemaker may include an icemaker box selectively closeable by a door. An outer gasket may be positioned about an inner edge of the door. A sealing gasket may be positioned around a center portion of the door. A plurality of protrusions may extend from a box rim of the icemaker box. A liner may be aligned with and spaced apart from the box rim. A first gasket and a second gasket may be positioned between the box rim and the liner.

According to another aspect, the plurality of protrusions may include a first protrusion positioned about an outer edge of the box rim, a second protrusion positioned between the outer edge of the box rim and an inner edge of the box rim, and a third protrusion positioned about the inner edge of the rim.

According to other aspects, the liner may include a liner rim having an inner surface and an edge.

According to yet another aspect, each of the inner surface and the edge of the liner rim may abut at least one of the plurality of protrusions.

According to other aspects, the plurality of protrusions may define a first channel and a second channel. The first gasket may be positioned within the first channel. The second gasket may be positioned within the second channel.

According to still other aspects, the outer gasket of the door may include a connecting portion and a contact portion. The contact portion may be compressed between the door and the box rim of the icemaker box when the door is in a closed position.

According to another aspect, the contact portion may be curvilinear and the connecting portion may be linear. The connecting portion may include at least one of the ends of the outer gasket.

According to yet another aspect, the contact portion may be substantially straight and the connecting portion may be non-linear. The connecting portion may include at least one of the ends of the outer gasket.

According to other aspects, the liner may include a corner portion positioned proximate the box rim of the icemaker box. One of the plurality of protrusions may be positioned within the corner portion.

According to still another aspect, the first channel may include a top portion, first and second side portions, and a bottom portion. A cross-section of the first channel may vary between each of the portions.

According to yet another aspect, the first and second gaskets may be compressible. The second gasket may be positioned proximate the sealing gasket when the door is closed.

According to still other aspects, an icemaker for a refrigerator appliance may be provided.

The icemaker may comprise an icemaker box defining an opening. The icemaker box may be selectively closeable by an icemaker door. The icemaker door may include an inner surface. A box rim of the icemaker box may define an outer channel and an inner channel. The outer channel may be defined by a first protrusion and a second protrusion. The inner channel may be defined by the second protrusion and a third protrusion. A first gasket may be positioned within the outer channel. A second gasket may be positioned within the inner channel. A liner may be positioned substantially flush with the icemaker box. An edge of the liner may include an inner surface. The inner surface of the edge may enclose the outer channel and the inner channel. An outer gasket may be positioned about the periphery of an inner surface of the icemaker door. The outer gasket may include a non-linear contact portion and a linear connecting portion.

According to another aspect, the icemaker door may include an inner portion configured to be received by the opening. A sealing gasket may be positioned about the inner portion.

According to still other aspects, the sealing gasket may abut the liner proximate the inner channel and the second gasket.

According to yet another aspect, the icemaker door may include an inner wall and an outer wall. At least one of the inner wall and the outer wall may define a slot.

According to other aspects, the connecting portion of the outer gasket may be at least partially received by the slot.

According to another aspect, an icemaker may be provided that comprises an icemaker box selectively closeable by a door. The door may include an inner wall and an outer wall. The inner wall may at least partially define a slot. A box rim of the icemaker box may define first and second channels having open ends. A first gasket may be positioned within the first channel. A second gasket may be positioned within the second channel. An outer gasket may be positioned about a periphery of the door. The outer gasket may include a contact portion and a connecting portion. The connecting portion may be at least partially received by the slot.

According to still other aspects, the outer gasket may include an angled connecting portion defining a space. The inner wall may be at least partially received by the space.

According to yet another aspect, the outer gasket may include a first end and a second end. The first and second ends may be received by the slot. An central portion of the gasket may define the contact portion.

According to other aspects, the inner wall may include first and second extensions proximate the slot. The first and second ends of the outer gasket may be positioned within the slot and may be at least partially covered by the first and second extensions, respectively.

According to still another aspect, the outer gasket may include a first end having an angled portion. The angled portion may extend from the connecting portion and may abut the inner wall.

According to another aspect, the contact portion may be generally curvilinear. The contact portion may be compressed between the inner wall and the icemaker box when the icemaker door is closed.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about," and one not modified by "about." It will be further understood that the end-points of each of the ranges are significant both in relation to the other end-point, and independently of the other end-point. The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other.

Furthermore, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected" or "operably coupled" to each other to achieve the desired functionality, and any two components capable of being so associated can also be viewed as being "operably couplable" to each other to achieve the desired functionality. Some examples of operably couplable include, but are not limited to, physically mateable and/or physically interacting components and/or wirelessly interactable and/or wirelessly interacting components and/or logically interacting and/or logically interactable components. Furthermore, it will be understood that a component preceding the term "of the" may be disposed at any practicable location (e.g., on, within, and/or externally disposed from the appliance) such that the component may function in any manner described herein.

It is also important to note that the construction and arrangement of the elements of the disclosure as shown in the exemplary examples is illustrative only. Although only a few examples of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system might be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary examples without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. An icemaker for a refrigerator appliance, the icemaker comprising:

an icemaker box selectively closeable by a door, wherein an outer gasket is positioned about an inner edge of the door and a sealing gasket is positioned around a center portion of the door;

a plurality of protrusions extending from a box rim of the icemaker box, wherein a liner is aligned with and spaced apart from the box rim; and a first gasket and a second gasket positioned between the box rim and the liner.

2. The icemaker of claim 1, wherein the plurality of protrusions includes a first protrusion positioned about an outer edge of the box rim, a second protrusion positioned between the outer edge of the box rim and an inner edge of the box rim, and a third protrusion positioned about the inner edge of the box rim.

3. The icemaker of claim 1, wherein the liner includes a liner rim having an inner surface and an edge, and further wherein each of the inner surface and the edge of the liner rim abuts at least one of the plurality of protrusions.

4. The icemaker of claim 1, wherein the plurality of protrusions defines a first channel and a second channel, and further wherein the first gasket is positioned within the first channel and the second gasket is positioned within the second channel.

5. The icemaker of claim 4, wherein the first channel includes a top portion, first and second side portions, and a bottom portion, and further wherein a cross-section of the first channel varies between each of the portions.

6. The icemaker of claim 1, wherein the outer gasket of the door includes a connecting portion and a contact portion, and further wherein the contact portion is compressed between the door and the box rim of the icemaker box when the door is in a closed position.

7. The icemaker of claim 6, wherein the contact portion is substantially straight and the connecting portion is non-linear, the connecting portion including at least one of the ends of the outer gasket.

8. The icemaker of claim 1, wherein the liner includes a corner portion positioned proximate the box rim of the icemaker box, and further wherein one of the plurality of protrusions is positioned within the corner portion.

9. The icemaker of claim 1, wherein the first and second gaskets are compressible, and further wherein the second gasket is positioned proximate the sealing gasket when the door is closed.

10. An icemaker for a refrigerator appliance, the icemaker comprising:

an icemaker box defining an opening, the icemaker box selectively closeable by an icemaker door, wherein the icemaker door includes an inner surface;

a box rim of the icemaker box, the box rim defining an outer channel and an inner channel, wherein the outer channel is defined by a first protrusion and a second protrusion, and further wherein the inner channel is defined by the second protrusion and a third protrusion;

a first gasket positioned within the outer channel and a second gasket positioned within the inner channel;

a liner positioned substantially flush with the icemaker box, wherein an edge of the liner includes an inner surface, and further wherein the inner surface of the edge encloses the outer channel and the inner channel; and an outer gasket positioned about the periphery of an inner surface of the icemaker door, wherein the outer gasket includes a non-linear contact portion and a linear connecting portion.

11. The icemaker of claim 10, wherein the icemaker door includes an inner portion configured to be received by the opening, and further wherein a sealing gasket is positioned about the inner portion.

12. The icemaker of claim 11, wherein the sealing gasket abuts the liner proximate the inner channel and the second gasket.

13. The icemaker of claim 11, wherein the icemaker door includes an inner wall and an outer wall, and further wherein at least one of the inner wall and the outer wall defines a slot.

14. The icemaker of claim 13, wherein the connecting portion of the outer gasket is at least partially received by the slot.

15. An icemaker comprising:

an icemaker box selectively closeable by a door, wherein the door includes an inner wall and an outer wall, the inner wall at least partially defining a slot;

a box rim of the icemaker box defining first and second channels having open ends, wherein a first gasket is positioned within the first channel and a second gasket is positioned within the second channel; and an outer gasket positioned about a periphery of the door, wherein the outer gasket includes a contact portion and a connecting portion, the connecting portion at least partially received by the slot.

16. The icemaker of claim 15, wherein the outer gasket includes an angled connecting portion defining a space, and further wherein the inner wall is at least partially received by the space.

17. The icemaker of claim 15, wherein the outer gasket include a first end and a second end, and further wherein the first and second ends are received by the slot and an central portion of the gasket defines the contact portion.

18. The icemaker of claim 17, wherein the inner wall includes first and second extensions proximate the slot, and further wherein the first and second ends of the outer gasket are positioned within the slot and at least partially covered by the first and second extensions, respectively.

19. The icemaker of claim 15, wherein the outer gasket includes a first end having an angled portion, and further wherein the angled portion extends from the connecting portion and abuts the inner wall.

20. The icemaker of claim 15, wherein the contact portion is generally curvilinear, and further wherein the contact portion is compressed between the inner wall and the icemaker box when the icemaker door is closed.

* * * * *